US010004924B1

(12) United States Patent
Anderson et al.

(10) Patent No.: US 10,004,924 B1
(45) **Date of Patent: *Jun. 26, 2018**

(54) HAZARDOUS-ENVIRONMENT DIVING SYSTEMS

(71) Applicant: Paragon Space Development Corporation, Tucson, AZ (US)

(72) Inventors: Grant A. Anderson, Tucson, AZ (US); Taber K. MacCallum, Tucson, AZ (US); Sebastian A. Padilla, Tucson, AZ (US); Chad E. Bower, Tucson, AZ (US)

(73) Assignee: Paragon Space Development Corporation, Tucson, AZ (US)

( * ) Notice: Subject to any disclaimer, the term of this patent is extended or adjusted under 35 U.S.C. 154(b) by 964 days.

This patent is subject to a terminal disclaimer.

(21) Appl. No.: 14/045,685

(22) Filed: Oct. 3, 2013

Related U.S. Application Data

(63) Continuation-in-part of application No. 12/338,944, filed on Dec. 18, 2008, now Pat. No. 8,555,884.

(Continued)

(51) Int. Cl.
*A62B 9/02* (2006.01)
*B63C 11/14* (2006.01)

(Continued)

(52) U.S. Cl.
CPC ..... *A62B 9/02* (2013.01); *A62B 7/00* (2013.01); *A62B 9/00* (2013.01); *A62B 9/022* (2013.01);

(Continued)

(58) Field of Classification Search
CPC .. A61M 16/00; A61M 16/0087; A61M 16/06; A61M 16/20; A61M 16/204;

(Continued)

(56) References Cited

U.S. PATENT DOCUMENTS 3,327,536 A 6/1967 Fitzgerald
3,968,794 A * 7/1976 O'Neill ..... B63C 11/14 128/201.27

(Continued)

FOREIGN PATENT DOCUMENTS

EP 0 006 726 A1 1/1980
EP 1 820 728 A2 8/2007

(Continued)

OTHER PUBLICATIONS

Kirby Morgan Dive Helmet 37, Operations and Maintenance Manual, KMDSI Part # 100-073, Document # 0401070001, Marine Marketing and Consulting & KMDSI, Kirby Morgan Dive Systems, Inc., Santa Barbara, California, USA, Copyright 1999-2004.

(Continued)

*Primary Examiner* — Colin W Stuart
(74) *Attorney, Agent, or Firm* — Weaver Austin Villeneuve and Sampson LLP

(57) ABSTRACT

A system is designed to increase diver safety in a high-risk environment containing one or more hazardous materials. The system includes chemically-hardened surface-supplied diving equipment designed to provide full environment isolation for the diver. The system also includes a dive helmet and a surface-return exhaust system, where the surface-return exhaust system includes a demand exhaust regulator that serves as a pressure-actuated valve to enable exhausting to a breathable atmosphere outside of a dive helmet instead of exhausting into the environment containing one or more hazardous materials. The system also includes retrofittable kits enabling the upgrading of contaminant-vulnerable materials of an existing dive helmet. The system also includes fluoroelastomeric materials and components to implement in a closed circuit dive system.

17 Claims, 13 Drawing Sheets

Related U.S. Application Data

(60) Provisional application No. 61/015,602, filed on Dec. 20, 2007.

(51) Int. Cl.

| | |
|---|---|
| ***B63C 11/20*** | (2006.01) |
| ***B63C 11/02*** | (2006.01) |
| ***B63C 11/06*** | (2006.01) |
| ***B63C 11/18*** | (2006.01) |
| ***B63C 11/12*** | (2006.01) |
| ***B63C 11/00*** | (2006.01) |
| ***A62B 9/00*** | (2006.01) |
| ***A62B 18/10*** | (2006.01) |
| ***A62B 18/00*** | (2006.01) |
| ***A62B 7/00*** | (2006.01) |

(52) U.S. Cl.

CPC ..... *A62B 18/006* (2013.01); *A62B 18/10* (2013.01); *B63C 11/00* (2013.01); *B63C 11/02* (2013.01); *B63C 11/06* (2013.01); *B63C 11/12* (2013.01); *B63C 11/14* (2013.01); *B63C 11/18* (2013.01); *B63C 11/20* (2013.01); *B63C 11/202* (2013.01)

(58) Field of Classification Search

CPC ..... A61M 16/205; A61M 16/206; A61M 16/208; A61M 16/209; B63C 11/00; B63C 11/02; B63C 11/06; B63C 11/12; B63C 11/14; B63C 11/18; B63C 11/20; B63C 11/202; B63C 11/2227; B63C 11/24; B63C 11/34; B63C 2011/182; A62B 7/00; A62B 9/00; A62B 9/006; A62B 9/02; A62B 9/022; A62B 15/00; A62B 18/00; A62B 18/006; A62B 18/02; A62B 18/04; A62B 18/10

USPC ..... 128/201.27, 200.24, 200.29, 201.11, 128/201.12, 201.22, 201.29, 205.19, 128/205.22, 205.24, 204.22, 205.25, 128/206.21

See application file for complete search history.

(56) References Cited

U.S. PATENT DOCUMENTS

| | | | | |
|---|---|---|---|---|
| 3,995,627 | A * | 12/1976 | O'Neill | B63C 11/06 128/201.15 |
| 4,026,283 | A * | 5/1977 | Banjavich | B63C 11/34 128/201.27 |
| 4,037,594 | A | 7/1977 | Riegel et al. | |
| 4,161,947 | A | 7/1979 | Copson | |
| 4,211,220 | A | 7/1980 | O'Neill | |
| 4,245,632 | A * | 1/1981 | Houston | B63C 11/202 128/201.11 |
| 4,362,153 | A | 12/1982 | Wilson et al. | |
| 4,502,817 | A | 3/1985 | Long | |
| 4,579,147 | A * | 4/1986 | Davies | B63C 11/08 137/854 |
| 4,625,759 | A * | 12/1986 | Craig | B63C 11/18 128/205.24 |
| 4,925,734 | A | 5/1990 | Agethen et al. | |
| 5,056,156 | A | 10/1991 | Kosmo et al. | |
| 5,195,516 | A | 3/1993 | Grimsey | |
| 5,940,878 | A | 8/1999 | Hattori et al. | |
| 5,980,158 | A | 11/1999 | Griffiths et al. | |
| 6,020,083 | A | 2/2000 | Breault et al. | |
| 6,029,712 | A | 2/2000 | Dougherty | |
| 6,319,599 | B1 | 11/2001 | Buckley | |
| 6,410,630 | B1 | 6/2002 | Hoover et al. | |
| 6,729,331 | B2 | 5/2004 | Kay | |
| 6,759,476 | B1 | 7/2004 | Hayes | |
| 6,759,494 | B2 | 7/2004 | Wlassics et al. | |
| 6,983,746 | B2 | 1/2006 | Morgan et al. | |
| D518,066 | S | 3/2006 | Morgan et al. | |
| 7,114,699 | B2 | 10/2006 | Hull et al. | |
| 8,555,884 | B2 * | 10/2013 | Anderson | B63C 11/202 128/201.22 |
| 2007/0062524 | A1 | 3/2007 | Morgan et al. | |
| 2007/0186926 | A1 | 8/2007 | Morgan et al. | |
| 2008/0023002 | A1 * | 1/2008 | Guelzow | A42B 3/042 128/201.24 |
| 2009/0172935 | A1 | 7/2009 | Anderson et al. | |
| 2015/0284061 | A1 | 10/2015 | Anderson et al. | |

FOREIGN PATENT DOCUMENTS

| | | | |
|---|---|---|---|
| FR | 2 294 082 | A1 | 7/1976 |
| GB | 00764 | A | 3/1897 |
| GB | 2028142 | A | 3/1980 |
| GB | 2132489 | A | 7/1984 |
| GB | 2 197 795 | A | 6/1988 |
| GB | 2201602 | A | 9/1988 |
| GB | 17407 | | 1/2013 |
| WO | WO9210400 | A2 | 6/1992 |
| WO | WO01048077 | A2 | 7/2001 |
| WO | WO2004088183 | A2 | 10/2004 |
| WO | WO 2009/117034 | A2 | 9/2009 |
| WO | WO 2015/105596 | A2 | 7/2015 |

OTHER PUBLICATIONS

U.S. Office Action, dated Sep. 26, 2012, issued in U.S. Appl. No. 12/338,944.

U.S. Notice of Allowance, dated Jun. 12, 2013, issued in U.S. Appl. No. 12/338,944.

U.S. Office Action, dated Mar. 28, 2016, issued in U.S. Appl. No. 14/553,907.

PCT International Search Report dated Sep. 29, 2009 issued in PCT/US2008/087604.

PCT International Preliminary Report on Patentability and Written Opinion dated Jun. 22, 2010 issued in PCT/US2008/087604.

European Extended Search Report dated Jul. 22, 2014 issued in EP 08 873 474.4.

European Examination Report dated Jul. 7, 2016 issued in EP 08 873 474.4.

PCT International Search Report and Written Opinion dated Sep. 2, 2015 issued in PCT/US2014/067723.

PCT International Preliminary Report on Patentability and Written Opinion dated Jun. 9, 2016 issued in PCT/US2014/067723.

Barsky (1999) "Diving in High-Risk Environments," *Dive Rescue International, Inc.*, Third Edition, 14pp.

"Guidance for Diving in Contaminated Waters 0910-LP-751-2700," Aug. 1, 2004 (Aug. 1, 2004), published by Direction of Commander Naval SeaSystems Command, [Retrieved on Jul. 14, 2014 from the Internet: URL:http://www.ndc.noaa.gov.pdfs/contaminated_water/USN_Contaminated_Water_Dive_Man.pdf], 35pp.

Phoenix International: "2nd Annual Multi-Agency Contaminated Water Diving Workshop, Report on Proceedings Contaminated Water Diving 2nd Annual Multi-Agency Workshop Executive Summary", *Past*, Jun. 20, 2007 (Jun. 20, 2007), pp. 1-17 [Retrieved on Jul. 11, 2014 from the Internet: URL:http://www.supsalv.org/conferences/CDW Workshop 2007/CWD2 Report on Processings web.pdf ].

U.S. Final Office Action, dated May 11, 2017, issued in U.S. Appl. No. 14/553,907.

U.S. Office Action, dated Aug. 10, 2017, issued in U.S. Appl. No. 14/553,907.

* cited by examiner

HAZARDOUS-ENVIRONMENT DIVING SYSTEMS

The present application is a continuation-in-part and is related to and claims priority from application Ser. No. 12/338,944, filed Dec. 18, 2008, entitled "HAZARDOUS-ENVIRONMENTAL DIVING SYSTEMS", which application is related to and claims priority from prior provisional application Ser. No. 61/015,602, filed Dec. 20, 2007, entitled "HAZARDOUS-ENVIRONMENTAL DIVING SYSTEMS", the contents all of which are incorporated herein by this reference and are not admitted to be prior art with respect to the present invention by the mention in this cross-reference section.

STATEMENT REGARDING FEDERALLY SPONSORED RESEARCH OR DEVELOPMENT

Some embodiments of this invention were developed with United States Government support under N00024-04-C-40 17 awarded by Naval Sea Systems Command. The United States Government may have certain rights in the invention.

BACKGROUND

This invention relates to providing a system for improved hazardous-environmental diving systems. More particularly, this invention relates to providing systems designed to increase diver safety in high-risk environments.

Military and professional divers are frequently exposed to contaminated waters in the course of carrying out routine duties, as well as operations arising from acts of terrorism, accidents, and disaster recovery operations. During recovery from a terrorist attack, such as on the USS Cole, dive operations after a ship wreck or aircraft wreck often necessitate dive operations in mixtures of water and jet fuel, hydraulic fluid, or fuel oils.

Current diving equipment is not designed to adequately protect a diver from exposure to contaminants in the water. Many dive environments are so hazardous that existing diving equipment can deteriorate to the point of failure in a matter of minutes, especially when exposed to contaminants such as diesel oil. This exposes the diver to hazardous chemicals and compounds with adverse health effects, as well as threatening nominal operation of the very equipment on which the diver's life depends. Chemical warfare agent (CWA) contamination, biological warfare agents (BWA) and disease from pollution such as sewage in harbors are also of special concern; even low agent concentrations in the water are, in effect, amplified by the high pressure and full immersion conditions experienced by the diver.

In recent tests, industry standard dive helmets, including the popular Kirby-Morgan MK-21, equipped with double exhaust valves, failed to prevent intrusion of water and aerosols when the diver exhaled or when the diver's head moved from the upright position at any operational depth.

In addition to the immediate dangers present from terrorism, accident and disaster recovery operations, military and professional divers are frequently exposed to contaminated water in the course of carrying out routine duties. It is now evident that divers are at risk from chronic exposure to contaminated water in harbors, ports and waterways. Studies have shown that naval divers with multiple exposures to waterborne carcinogens are two times more likely to contract cancer then control populations.

The efforts to help in rescue and cleanup in Louisiana following Hurricane Katrina further illustrated problems related to the lack of "chemically hardened" dive equipment. Because industry-standard dive equipment is inadequately protective for use in chemically contaminated waters, responding divers working in the region reported delays to critical diving operations while evaluations of water conditions were completed.

Clearly, there exists an immediate need for improved "chemically hardened" dive hardware technology across the entire diving community. Furthermore, systems allowing the retrofitting and upgrade of existing dive hardware would provide a reasonably quick means for implementing such hazardous-environmental diving systems.

OBJECTS AND FEATURES OF THE INVENTION

A primary object and feature of the present invention is to provide a system overcoming the above-mentioned problems.

It is a further object and feature of the present invention to provide such a system providing dive equipment that is "factory hardened" to include contaminate-resistant materials and physical configurations to limit the intrusion of hazardous materials within suit environment.

It is another object and feature of the present invention to provide such a system consisting of dive helmets implementing Return Surface Exhaust (RSE) technology.

It is a further object and feature of the present invention to provide such a system comprising one or more "retrofittable kits" comprising the above-described technologies and the related method of designing kits that fit new helmet models as they are developed.

It is another object and feature of the present invention to provide such a system, enabling protection of methods of use of such modified dive equipment within waters, requiring zero discharge of breathing gas into the aqueous medium.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a system relating to protective underwater dive systems adapted to enhance the safety of at least one diver operating in waters containing at least one hazardous material, such system comprising: at least one set of components structured and arranged to, when operably associated, assist forming at least one protected breathing environment available to the at least one diver operating in the waters containing the at least one hazardous material; wherein such at least one set of components at least comprises at least one dive helmet, and at least one surface-supplied breathing-gas subsystem; wherein such at least one dive helmet comprises at least one continuous barrier structured and arranged to limit transmission of the at least one hazardous material between the waters containing the at least one hazardous material and the at least one protected breathing environment; wherein at least one portion of such at least one continuous barrier comprises at least one flouroelastomer composition; wherein, within at least one operational duration, such flouroelastomer composition is substantially resistant to degraded physical performance by contact with the at least one hazardous material, and transmission of hazardous quantities of the at least one hazardous material into the at least one breathing environment, by permeation of the at least one hazardous material across such flouroelastomer composition; wherein the safety of the at least one diver, while operating in waters containing the at least one hazardous material, is enhanced.

Moreover, it provides such a system further comprising at least one surface-return exhaust subsystem structured and arranged to exhaust breathing gas from the at least one breathing environment of such at least one dive helmet to the surface. Additionally, it provides such a system wherein such surface-return exhaust subsystem comprises: at least one breathing-gas return hose structured and arranged to return breathing gas to the surface; at least one demand-based exhaust regulator structured and arranged to regulate, essentially on demand, exhausting of the breathing gas from the at least one breathing environment of such at least one dive helmet to such at least one breathing-gas return hose; and at least one exhaust coupler structured and arranged to operably couple such at least one demand-based exhaust regulator to the at least one breathing environment of such at least one dive helmet; wherein at least one demand-based exhaust pathway may be established between the at least one breathing environment of such at least one dive helmet and the surface.

Also, it provides such a system wherein such surface-return exhaust subsystem further comprises: between such at least one exhaust coupler and such at least one demand-based exhaust regulator, at least one over-pressure relief valve structured and arranged to relieve over pressures within the at least one breathing environment within such at least one dive helmet; and between such at least one exhaust coupler and such at least one demand-based exhaust regulator, at least one gas-flow control valve structured and arranged to control the routing of the breathing gas between the at least one breathing environment of such at least one dive helmet, such at least one demand-based exhaust regulator, and such at least one breathing-gas return hose; wherein such at least one gas-flow control valve comprises at least one first flow setting to enable exhausting of the breathing gas from the at least one breathing environment of such at least one dive helmet to such at least one demand-based exhaust regulator, at least one second flow setting to enable exhausting of the breathing gas from the at least one breathing environment of such at least one dive helmet directly to such at least one breathing-gas return hose essentially without passage through such at least one demand-based exhaust regulator, and at least one third flow setting to enable exhausting of the breathing gas from the at least one breathing environment of such at least one dive helmet substantially entirely through such at least one over-pressure relief valve by preventing exhausting of the breathing gas through aid at least one demand-based exhaust regulator and such at least one breathing-gas return hose.

In addition, it provides such a system wherein such at least one surface-return exhaust subsystem further comprises: at least one reduced-pressure source structured and arranged to provide at least one source of reduced atmospheric pressure; at least one reduced-pressure communicator structured and arranged to establish fluid communication between such at least one reduced-pressure source and such at least one breathing-gas return hose; and at least one back-pressure regulator structured and arrange to regulate levels of reduced atmospheric pressure communicated between such at least one reduced-pressure source and such at least one breathing-gas return hose. And, it provides such a system wherein such at least one surface-return exhaust subsystem further comprises: at least one pressure indicator structured and arranged to indicate at least one pneumatic reference pressure, and at least one indication of operating pressure at such at least one demand-based exhaust regulator; and at least one breathing-gas monitor structured and arranged to monitor the breathing gas of the at least one breathing environment for levels of the at least one hazardous material; wherein such at least one breathing-gas monitor comprises at least one breathing-gas sampling component structured and arranged to sample the breathing gas of the at least one breathing environment, at least one measurement component structured and arranged to measure the levels of the at least one hazardous material of the sampled breathing gas to determine if the levels of the at least one hazardous material fall within a preset range, and at least one hazardous-condition indicator structured and arranged to indicate if the levels of the at least one hazardous material exceed the preset range. Further, it provides such a system wherein such at least one breathing-gas supply hose comprises at least one chemical-resistant hose material structured and arranged to maintain the functional integrity of the at least one breathing-gas supply hose when such at least one breathing-gas supply hose is in contact with the at least one hazardous material.

Even further, it provides such a system further comprising: at least one chemical-resistant hose covering structured and arranged to cover the at least one breathing-gas supply hose; wherein such at least one chemical-resistant hose covering is structured and arranged to maintain the functional integrity of the at least one breathing-gas supply hose while operating in the waters containing the at least one hazardous material. Moreover, it provides such a system wherein such at least one dive helmet further comprises: at least one outer-shell-portion defining at least one internal cavity into which at least one body portion of the at least one diver can be situated; wherein such at least one outer-shell-portion is constructed from at least one material having low transmissibility with respect to the at least one hazardous material; and wherein such at least one outer-shell-portion is configured to limit intrusion of hazardous quantities of the at least one hazardous material into the at least one breathing environment by reducing transmission of the at least one hazardous material through such at least one outer-shell-portion.

Additionally, it provides such a system further comprising: at least one helmet coating structured and arranged to coat at least one possibly-permeable outer-shell-portion of such at least one dive helmet; wherein such at least one helmet-coating is further structured and arranged to reduce transmission of hazardous quantities of the at least one hazardous material into the at least one breathing environment by reducing contact interaction between the at least one hazardous material and the at least one possibly-permeable outer-shell-portion of such at least one dive helmet. Also, it provides such a system further comprising: at least one sealant structured and arranged to reduce migration of hazardous quantities of the at least one hazardous material, into the at least one breathing environment of such at least one dive helmet, by interstitial penetration of the at least one hazardous material between such at least one set of components; and wherein such at least one sealant comprises at least one flouroelastomer-based composition.

In addition, it provides such a system wherein such at least one demand-based exhaust regulator comprises: at least one demand-based valve assembly structured and arranged to control, essentially on demand, passage of the breathing gas through such at least one demand-based exhaust regulator; at least one valve housing structured and arranged to house such at least one demand-based valve assembly; at least one inlet duct structured and arranged to inlet the breathing gas, exhausted from the at least one breathing environment of such at least one dive helmet, to such at least one demand-based valve assembly; and at least one outlet duct structured and arranged to outlet the breathing gas, from such at least one demand-based valve assembly, to such at least one breathing-gas return hose; wherein such at least one demand-based valve assembly comprises disposed between such at least one inlet duct and such at least one outlet duct, at least one valve seat, comprising a plurality of gas-conducting passages, structured and arranged to enable passage of the breathing gas therethrough, and in at least one superimposed placement adjacent such at least one valve seat, at least one diaphragm structured and arranged to be in pressure communication with such at least one inlet duct, such at least one outlet duct and ambient water pressure; wherein such at least one diaphragm is flexibly movable between at least one flow-blocking position substantially engaging such at least one valve seat and at least one flow-delivery position disengaging such at least one valve seat; wherein, while in such at least one flow-blocking position, such at least one diaphragm substantially blocks the passage of the breathing gas through such plurality of gas-conducting passages; wherein, while in such at least one flow-delivery position, such at least one diaphragm enables the passage of the breathing gas from such at least one inlet duct through such plurality of gas-conducting passages to such at least one outlet duct; and wherein exhausting of the breathing gas from the at least one breathing environment applies a pressurizing bias force to such at least one diaphragm flexibly moving at least one portion of such at least one flexible diaphragm from such at least one flow-blocking position to such at least one flow-delivery position. And, it provides such a system wherein such at least one valve seat comprises: at least one central bore structured and arranged to be in fluid communication with such at least one inlet duct, such at least one central bore comprising at least one central axis; extending radially outward of such at least one central bore, at least one circumferential sealing surface structured and arranged to form at least one pressure seal with such at least one diaphragm; and at least one smooth-sweep transition-surface structured and arranged to provide at least one smoothly sweeping transition between such at least one central bore and such at least one circumferential sealing surface; wherein such plurality of gas-conducting passages are located within such at least one circumferential sealing surface.

Further, it provides such a system wherein: each one of such plurality of gas-conducting passages comprises a hollow frustoconical aperture; each such hollow frustoconical aperture comprises at least one inlet diameter structured and arranged to minimize unsupported areas of such at least one diaphragm when such at least one diaphragm is in such at least one flow-blocking position, and at least one outlet diameter structured and arranged to beneficially optimize mass flow through such at least one valve seat. Even further, it provides such a system wherein such at least one diaphragm is further structured and arranged to generally conform to such at least one circumferential sealing surface when engaged with such at least one circumferential sealing surface. Even further, it provides such a system wherein such at least one diaphragm further comprises: at least one asymmetrical stiffener structured and arranged to structurally stiffen at least one portion of such at least one diaphragm; wherein such asymmetrical structural stiffening reduces the level of pressure forces required to flexibly move such at least one portion of such at least one flexible diaphragm from such at least one flow-blocking position to such at least one flow-delivery position. In accordance with another preferred embodiment hereof, this invention provides a method, relating to the generation of protective underwater dive systems adapted to enhance the safety of at least one diver operating in waters containing at least one hazardous material, such method comprising the steps of: providing at least one set of components that are structured and arranged to, when associated, assist in forming at least one protected breathing environment available to the at least one diver operating in the waters containing the at least one hazardous material; wherein such at least one set of components at least comprises at least one dive helmet, and at least one surface-supplied breathing-gas subsystem; wherein such at least one dive helmet comprises at least one continuous barrier structured and arranged to limit transmission of the at least one hazardous material between the waters containing the at least one hazardous material and the at least one protected breathing environment; wherein at least one portion of such at least one continuous barrier comprises at least one flouroelastomer composition; wherein, within at least one operational duration, such flouroelastomer composition is substantially resistant to degraded physical performance by contact with the at least one hazardous material, and transmission of hazardous quantities of the at least one hazardous material into the at least one breathing environment, by permeation of the at least one hazardous material across such flouroelastomer composition; wherein the safety of the at least one diver, while operating in waters containing the at least one hazardous material, is enhanced.

Even further, it provides such a method further comprising the step of providing at least one surface-return exhaust subsystem structured and arranged to exhaust breathing gas from the at least one breathing environment of such at least one dive helmet to the surface. In accordance with another preferred embodiment hereof, this invention provides a system relating to protective underwater dive systems adapted to enhance the safety of at least one diver operating in waters containing at least one hazardous material, such system comprising: breathing environment containing means for containing at least one portion of at least one protected breathing environment available to the at least one diver operating in the waters containing the at least one hazardous material; wherein such breathing-environment containing means at least comprises body-portion holding means for holding at least one respiration-related body portion of the at least one diver within the at least one protected breathing environment, breathing-gas supplying means for supplying at least one breathing gas used to form the at least one portion of the at least one protected breathing environment, hazardous material blocking means for blocking transmission of the at least one hazardous material between the waters containing the at least one hazardous material and the at least one protected breathing environment, within such breathing-environment containing means; wherein at least one portion of such hazardous material blocking means comprises at least one hazardous-material-resistant flouroelastomer composition; wherein, within at least one operational duration, such at least one hazardous-material-resistant flouroelastomer composition is substantially resistant to degraded physical performance by contact with the at least one hazardous material; and wherein the safety of the at least one diver, while operating in waters containing the at least one hazardous material, is enhanced. Even further, it provides such a system wherein such breathing-gas supplying means comprises surface-gas looping means for supplying the at least one breathing gas from at least one surface source and exhausting the at least one breathing gas from the at least one breathing environment of such breathing-environment containing means to the surface.

In accordance with a preferred embodiment hereof, this invention provides a method related to retrofitting at least one existing underwater dive system to enhance the safety of at least one diver operating in waters containing at least one hazardous material, such at least one existing underwater dive system comprising at least one existing dive helmet, at least one existing surface-supplied breathing-gas subsystem, at least one existing in-water exhaust subsystem, and at least one breathing environment available to the at least one diver, such method comprising the steps of: identifying at least one such existing underwater dive system comprising the at least one existing dive helmet, the at least one existing surface-supplied breathing-gas subsystem, and the at least one in-water exhaust subsystem; identifying, within the at least one existing underwater dive system, potential hazardous-material-caused failure points that result in at least one injurious introduction of at least one hazardous material into the at least one breathing environment during at least one operational duration; designing at least one risk-mitigating modification to such at least one existing underwater dive system, such at least one risk-mitigating modification being structured and arranged to substantially mitigate risks associated with such hazardous-material-caused failure points identified to occur within the at least one operational duration; providing at least one retrofit kit comprising materials and procedures required to implement such at least one risk-mitigating modification to such at least one existing underwater dive system. Moreover, it provides such a method wherein the step of providing at least one risk-mitigating modification further comprises the step of integrating such at least one risk-mitigating modification into such at least one existing underwater dive system. Additionally, it provides such a method wherein the step of providing at least one risk-mitigating modification further comprises the step of: providing at least one soft-goods replacement for at least one existing hazardous-material-susceptible soft good experiencing exposure to the at least one hazardous material during the at least one operational duration; wherein the at least one soft-goods replacement comprises at least one hazardous-material-resistant composition; and wherein, within the at least one operational duration, such at least one hazardous-material-resistant composition is substantially resistant to degraded physical performance by contact with the at least one hazardous material, and transmission of hazardous quantities of the at least one hazardous material into the at least one breathing environment by permeation of the at least one hazardous material through such hazardous-material-resistant composition. Also, it provides such a method wherein such at least one hazardous-material-resistant composition comprises at least one flouroelastomer. In addition, it provides such a method wherein the step of providing such at least one soft-goods replacement further comprises the step of integrating such at least one soft-goods replacement within such at least one existing underwater dive system. And, it provides such a method wherein the step of providing at least one risk-mitigating modification further comprises the steps of: providing at least one in-water-exhaust disabler to disable the at least one existing in-water exhaust subsystem; providing at least one surface-return exhaust subsystem structured and arranged to exhaust breathing gas from the at least one breathing environment of the at least one existing dive helmet to the surface; wherein at least one entry path for inhalable amounts of the at least one hazardous material may be removed. Further, it provides such a method wherein the surface-return exhaust subsystem comprises: at least one breathing-gas return hose structured and arranged to return breathing gas to the surface; at least one demand-based exhaust regulator structured and arranged to regulate, essentially on demand, exhausting of the breathing gas from the at least one breathing environment of the at least one existing dive helmet to such at least one breathing-gas return hose; and at least one exhaust coupler structured and arranged to operably couple such at least one demand-based exhaust regulator to the at least one breathing environment of the at least one existing dive helmet; wherein at least one demand-based exhaust pathway may be established between the at least one breathing environment of the at least one existing dive helmet and the surface. Even further, it provides such a method wherein the surface-return exhaust subsystem further comprises: between such at least one exhaust coupler and such at least one demand-based exhaust regulator, at least one over-pressure relief valve structured and arranged to relieve over pressures within the at least one breathing environment within the at least one existing dive helmet; and between such at least one exhaust coupler and such at least one demand-based exhaust regulator, at least one gas-flow control valve structured and arranged to control the routing of the breathing gas between the at least one breathing environment of the at least one existing dive helmet, such at least one demand-based exhaust regulator, and such at least one breathing-gas return hose; wherein such at least one gas-flow control valve comprises at least one first flow setting to enable exhausting of the breathing gas from the at least one breathing environment of the at least one existing dive helmet to such at least one demand-based exhaust regulator, at least one second flow setting to enable exhausting of the breathing gas from the at least one breathing environment of the at least one existing dive helmet directly to such at least one breathing-gas return hose without passage through such at least one demand-based exhaust regulator, and at least one third flow setting to enable exhausting of the breathing gas from the at least one breathing environment of the at least one existing dive helmet substantially entirely through such at least one over-pressure relief valve by preventing exhausting of the breathing gas through such at least one demand-based exhaust regulator and such at least one breathing-gas return hose. Moreover, it provides such a method wherein the step of providing such at least one surface-return exhaust subsystem further comprises the steps of: providing at least one reduced-pressure source structured and arranged to provide at least one source of reduced atmospheric pressure; providing at least one reduced-pressure communicator structured and arranged to establish fluid communication between such at least one reduced-pressure source and such at least one breathing-gas return hose; and providing at least one back-pressure regulator structured and arrange to regulate levels of reduced atmospheric pressure communicated between such at least one reduced-pressure source and such at least one breathing-gas return hose. Additionally, it provides such a method wherein the step of providing such at least one surface-return exhaust subsystem further comprises the step of: providing at least one pressure indicator structured and arranged to indicate at least one pneumatic reference pressure, and at least one indication of pressure at such at least one demand-based exhaust regulator; and providing at least one breathing-gas monitor structured and arranged to monitor the breathing gas of the at least one breathing environment for levels of the at least one hazardous material; wherein such at least one breathing-gas monitor comprises at least one breathing-gas sampling component structured and arranged to sample the breathing gas of the at least one breathing environment, at least one measurement component structured and arranged to measure the levels of the at least one hazardous material of the sampled breathing gas to determine if the levels of the at least one hazardous material fall within a preset range, and at least one hazardous-condition indicator structured and arranged to indicate to at least one system operator if the levels of the at least one hazardous material exceed the preset range. Also, it provides such a method wherein the step of providing such at least one surface-return exhaust subsystem further comprises the step of integrating such at least one surface-return exhaust subsystem within such at least one existing underwater dive system. In addition, it provides such a method wherein the step of providing at least one risk-mitigating modification further comprises the step of: providing at least one optical-faceplate covering structured and arranged to substantially cover at least one existing optical faceplate of the at least one existing dive helmet; wherein, within the at least one operational duration, such at least one optical-faceplate covering comprises at least one hazardous-material-resistant material substantially resistant to degraded physical performance by contact with the at least one hazardous material, and introduction of hazardous levels of the at least one hazardous material into the at least one breathing environment by permeation of the at least one hazardous material through such at least one hazardous-material-resistant material; and wherein such at least one hazardous-material-resistant material comprises sufficient transparency as to maintain a level of optical viewing through the at least one existing optical faceplate. And, it provides such a method wherein such at least one optical faceplate cover comprises at least one surface lamination of at least one glass material. Further, it provides such a method wherein the step of providing such at least one optical faceplate cover further comprises the step of integrating such at least one optical faceplate cover within such at least one existing underwater dive system. Even further, it provides such a method wherein the step of providing at least one risk-mitigating modification further comprises the step of: providing at least one chemical-resistant hose covering structured and arranged to cover the at least one existing breathing-gas supply hose; wherein the at least one chemical-resistant hose covering is structured and arranged to maintain the functional integrity of the at least one existing breathing-gas supply hose, within the at least one operational duration. Moreover, it provides such a method wherein the step of providing at least one mitigating modification further comprises the steps of modifying such at least one existing breathing-gas supply hose to comprise such at least one chemical-resistant covering. Additionally, it provides such a method wherein the step of providing at least one risk-mitigating modification further comprises the step of: providing at least one helmet coating usable to coat at least one possibly-permeable outer-shell-portion of the at least one existing dive helmet; wherein such at least one helmet-coating is structured and arranged to reduce transmission of hazardous quantities of the at least one hazardous material into the at least one breathing environment by reducing contact interaction between the at least one hazardous material and the at least one possibly-permeable outer-shell-portion of the at least one existing dive helmet. Also, it provides such a method wherein the step of providing at least one risk-mitigating modification further comprises the step of: providing at least one replacement sealant structured and arranged to replace existing sealants of the at least one existing underwater dive system; wherein such at least one replacement sealant is structured and arranged to reduce transmission of hazardous quantities of the at least one hazardous material into the at least one breathing environment of the at least one existing dive helmet by permeation of the at least one hazardous material through such at least one replacement sealant. In addition, it provides such a method wherein such at least one replacement sealant comprises at least one room-temperature-cured flouroelastomer-based composition. And, it provides such a method wherein the step of providing at least one risk-mitigating modification further comprises the step of integrating such at least one replacement sealant within such at least one existing underwater dive system.

In accordance with another preferred embodiment hereof, this invention provides a kit system related to retrofitting at least one existing underwater dive system to enhance the safety of at least one diver operating in waters containing at least one hazardous material, such at least one existing underwater dive system comprising at least one existing dive helmet, at least one existing surface-supplied breathing-gas subsystem, at least one existing in-water exhaust subsystem, and at least one breathing environment available to the at least one diver, such system comprising: at least one soft-goods replacement structured and arranged to replace at least one existing hazardous-material-susceptible soft good experiencing exposure to the at least one hazardous material during the at least one operational duration; wherein the at least one soft-goods replacement comprises at least one hazardous-material-resistant composition; and wherein, within the at least one operational duration, such at least one hazardous-material-resistant composition is substantially resistant to degraded physical performance by contact with the at least one hazardous material, and transmission of hazardous quantities of the at least one hazardous material into the at least one breathing environment by permeation of the at least one hazardous material through such hazardous-material-resistant composition. Further, it provides such a kit system wherein such at least one hazardous-material-resistant composition comprises at least one flouroelastomer. Even further, it provides such a kit system further comprising: at least one in-water-exhaust disabler structured and arranged to disable the at least one existing in-water exhaust subsystem; and at least one surface-return exhaust subsystem structured and arranged to exhaust breathing gas from the at least one breathing environment of the at least one existing dive helmet to the surface; wherein at least one entry path for inhalable amounts of the at least one hazardous material may be removed. Moreover, it provides such a kit system wherein such surface-return exhaust subsystem comprises: at least one breathing-gas return hose structured and arranged to return breathing gas to the surface; at least one demand-based exhaust regulator structured and arranged to regulate, essentially on demand, exhausting of the breathing gas from the at least one breathing environment of the at least one existing dive helmet to such at least one breathing-gas return hose; and at least one exhaust coupler structured and arranged to operably couple such at least one demand-based exhaust regulator to the at least one breathing environment of the at least one existing dive helmet; wherein at least one demand-based exhaust pathway may be established between the at least one breathing environment of the at least one existing dive helmet and the surface. Additionally, it provides such a kit system wherein such surface-return exhaust subsystem further comprises: between such at least one exhaust coupler and such at least one demand-based exhaust regulator, at least one over-pressure relief valve structured and arranged to relieve over pressures within the at least one breathing environment within the at least one existing dive helmet; and between such at least one exhaust coupler and such at least one demand-based exhaust regulator, at least one gas-flow control valve structured and arranged to control the routing of the breathing gas between the at least one breathing environment of the at least one existing dive helmet, such at least one demand-based exhaust regulator, and such at least one breathing-gas return hose; wherein such at least one gas-flow control valve comprises at least one first flow setting to enable exhausting of the breathing gas from the at least one breathing environment of the at least one existing dive helmet to such at least one demand-based exhaust regulator, at least one second flow setting to enable exhausting of the breathing gas from the at least one breathing environment of the at least one existing dive helmet directly to such at least one breathing-gas return hose essentially without passage through such at least one demand-based exhaust regulator, and at least one third flow setting to enable exhausting of the breathing gas from the at least one breathing environment of the at least one existing dive helmet substantially entirely through such at least one over-pressure relief valve by preventing exhausting of the breathing gas through aid at least one demand-based exhaust regulator and such at least one breathing-gas return hose. Also, it provides such a kit system wherein such at least one surface-return exhaust subsystem further comprises: at least one reduced-pressure source structured and arranged to provide at least one source of reduced atmospheric pressure; at least one reduced-pressure communicator structured and arranged to establish fluid communication between such at least one reduced-pressure source and such at least one breathing-gas return hose; and at least one back-pressure regulator structured and arrange to regulate levels of reduced atmospheric pressure communicated between such at least one reduced-pressure source and such at least one breathing-gas return hose. In addition, it provides such a kit system wherein such at least one surface-return exhaust subsystem further comprises: at least one pressure indicator structured and arranged to indicate at least one pneumatic reference pressure, and at least one indication of operating pressure at such at least one demand-based exhaust regulator; and at least one breathing-gas monitor structured and arranged to monitor the breathing gas of the at least one breathing environment for levels of the at least one hazardous material; wherein such at least one breathing-gas monitor comprises at least one breathing-gas sampling component structured and arranged to sample the breathing gas of the at least one breathing environment, at least one measurement component structured and arranged to measure the levels of the at least one hazardous material of the sampled breathing gas to determine if the levels of the at least one hazardous material fall within a preset range, and at least one hazardous-condition indicator structured and arranged to indicate if the levels of the at least one hazardous material exceed the preset range. And, it provides such a kit system further comprising: at least one optical-faceplate cover structured and arranged to substantially cover at least one existing optical faceplate of the at least one existing dive helmet; wherein, within the at least one operational duration, such at least one optical-faceplate cover comprises at least one hazardous-material-resistant material substantially resistant to degraded physical performance by contact with the at least one hazardous material, and introduction of hazardous levels of the at least one hazardous material into the at least one breathing environment by permeation of the at least one hazardous material through such at least one hazardous-material-resistant material; and wherein such at least one hazardous-material-resistant material comprises sufficient transparency as to maintain a level of optical viewing through the at least one existing optical faceplate. Further, it provides such a kit system wherein such at least one optical faceplate cover comprises at least one glass material. Even further, it provides such a kit system further comprising: at least one chemical-resistant hose covering structured and arranged to cover the at least one existing breathing-gas supply hose; wherein such at least one chemical-resistant hose covering is structured and arranged to maintain the functional integrity of the at least one existing breathing-gas supply hose, within the at least one operational duration. Moreover, it provides such a kit system further comprising: at least one helmet coating structured and arranged to coat at least one possibly-permeable outer-shell-portion of the at least one existing dive helmet; wherein such at least one helmet-coating is further structured and arranged to reduce transmission of hazardous quantities of the at least one hazardous material into the at least one breathing environment by reducing contact interaction between the at least one hazardous material and the at least one possibly-permeable outer-shell-portion of the at least one existing dive helmet. Additionally, it provides such a kit system further comprising: at least one replacement sealant structured and arranged to replace existing sealants of the at least one existing commercial dive system; wherein such at least one replacement sealant is structured and arranged to reduce transmission of hazardous quantities of the at least one hazardous material into the at least one breathing environment of the at least one existing dive helmet by permeation of the at least one hazardous material through such at least one replacement sealant. Also, it provides such a kit system wherein such at least one replacement sealant comprises at least one room-temperature-cured flouroelastomer-based composition. In addition, it provides such a kit system wherein such at least one demand-based exhaust regulator comprises: at least one demand-based valve assembly structured and arranged to control, essentially on demand, passage of the breathing gas through such at least one demand-based exhaust regulator; at least one valve housing structured and arranged to house such at least one demand-based valve assembly; at least one inlet duct structured and arranged to inlet the breathing gas, exhausted from the at least one breathing environment of the at least one existing dive helmet, to such at least one demand-based valve assembly; and at least one outlet duct structured and arranged to outlet the breathing gas, from such at least one demand-based valve assembly, to such at least one breathing-gas return hose; wherein such at least one demand-based valve assembly comprises disposed between such at least one inlet duct and such at least one outlet duct, at least one valve seat, comprising a plurality of gas-conducting passages, structured and arranged to enable passage of the breathing gas therethrough, and in at least one superimposed placement adjacent such at least one valve seat, at least one diaphragm structured and arranged to be in pressure communication with such at least one inlet duct, such at least one outlet duct and ambient water pressure; wherein such at least one diaphragm is flexibly movable between at least one flow-blocking position substantially engaging such at least one valve seat and at least one flow-delivery position disengaging such at least one valve seat; wherein, while in such at least one flow-blocking position, such at least one diaphragm substantially blocks the passage of the breathing gas through such plurality of gas-conducting passages; wherein, while in such at least one flow-delivery position, such at least one diaphragm enables the passage of the breathing gas from such at least one inlet duct through such plurality of gas-conducting passages to such at least one outlet duct; and wherein exhausting of the breathing gas from the at least one breathing environment applies a pressurizing bias force to such at least one diaphragm flexibly moving at least one portion of such at least one flexible diaphragm from such at least one flow-blocking position to such at least one flow-delivery position. And, it provides such a kit system wherein such at least one valve seat comprises: at least one central bore structured and arranged to be in fluid communication with such at least one inlet duct, such at least one central bore comprising at least one central axis; extending radially outward of such at least one central bore, at least one circumferential sealing surface structured and arranged to form at least one pressure seal with such at least one diaphragm; and at least one smooth-sweep transition-surface structured and arranged to provide at least one smoothly sweeping transition between such at least one central bore and such at least one circumferential sealing surface; wherein such plurality of gas-conducting passages are located within such at least one circumferential sealing surface. Further, it provides such a kit system wherein: each one of such plurality of gas-conducting passages comprises a hollow frustoconical aperture; each such hollow frustoconical aperture comprises at least one inlet diameter structured and arranged to minimize unsupported areas of such at least one diaphragm when such at least one diaphragm is in such at least one flow-blocking position, and at least one outlet diameter structured and arranged to beneficially optimize mass flow through such at least one valve seat. Even further, it provides such a kit system wherein such at least one diaphragm is further structured and arranged to generally conform to such at least one circumferential sealing surface when engaged with such at least one circumferential sealing surface. Even further, it provides such a kit system wherein such at least one diaphragm further comprises: at least one asymmetrical stiffener structured and arranged to structurally stiffen at least one portion of such at least one diaphragm; wherein such asymmetrical structural stiffening reduces the level of pressure forces required to flexibly move such at least one portion of such at least one flexible diaphragm from such at least one flow-blocking position to such at least one flow-delivery position.

In accordance with another preferred embodiment hereof, this invention provides a method, related to use of at least one existing commercial dive system to avoid health hazards relating to at least one diver operating in waters needed to be essentially uncontaminated, such at least one existing commercial dive system comprising at least one existing dive helmet, at least one existing demand-based breathing-gas supply subsystem, at least one existing in-water exhaust subsystem, and at least one breathing environment available to the at least one diver, such method comprising the steps of: identifying at least one such existing commercial dive system comprising the at least one existing dive helmet, the at least one existing demand-based breathing-gas supply subsystem, and the at least one in-water exhaust subsystem; and modifying such at least one such existing commercial dive system by providing at least one in-water-exhaust disabler to disable the at least one existing in-water exhaust subsystem, and providing at least one surface-return exhaust subsystem structured and arranged to exhaust breathing gas from the at least one breathing environment of the at least one existing dive helmet to the surface; wherein use of such at least one modified existing commercial dive system in such waters assists in avoiding water contamination relating to such exhaust breathing gas. In addition, it provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
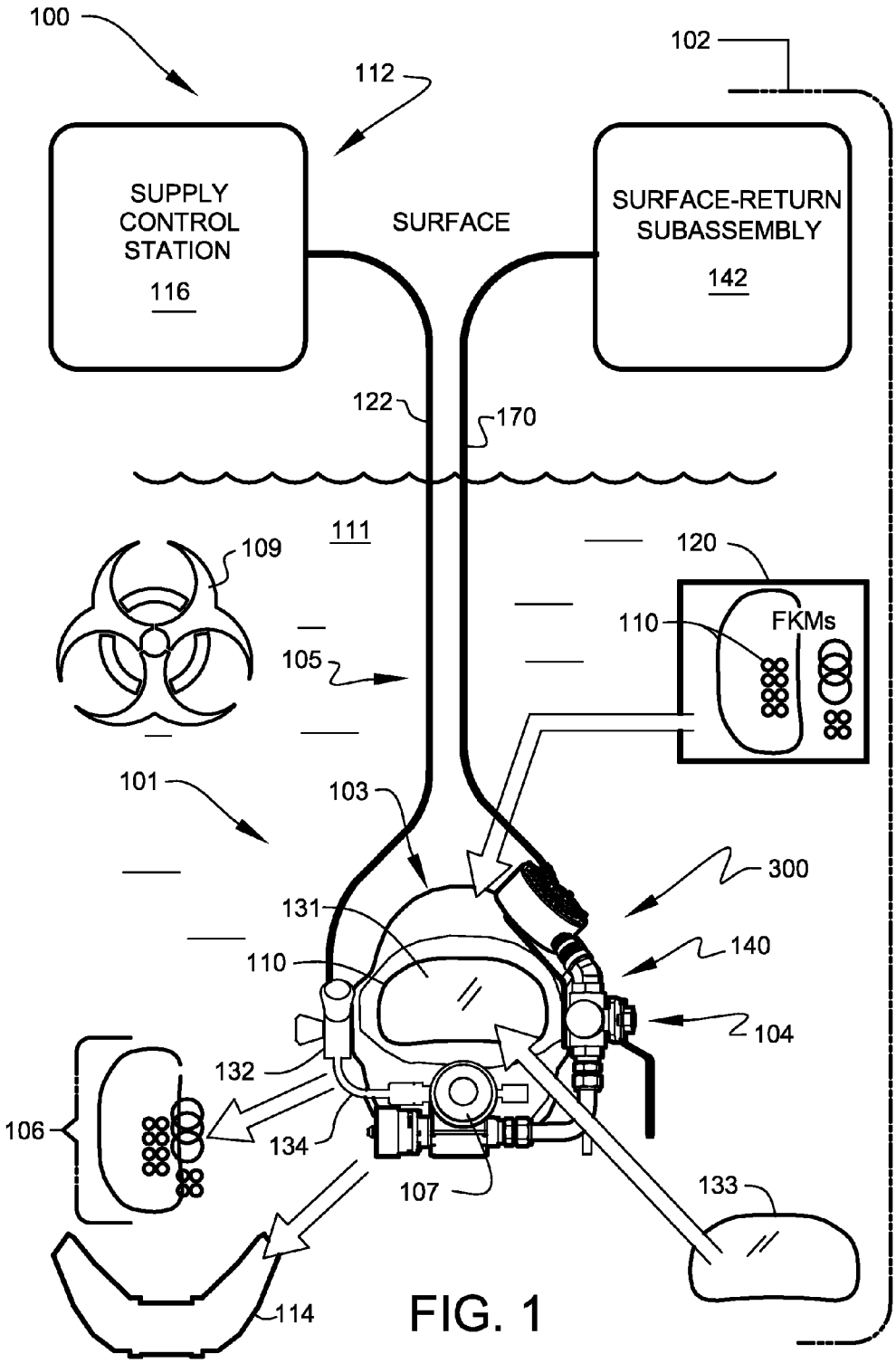
FIG. 1 shows a schematic diagram, generally illustrating an existing dive system modified to comprise retrofits designed to enhance diver safety during operation in waters containing at least one hazardous material, according to a preferred embodiment of the present invention.

FIG. 1 shows a schematic diagram, generally illustrating preferred arrangements of Hazardous Material-hardened Regulated Surface Exhaust Diving System (HMRSEDS) 300, according to a preferred embodiment of the present invention. Preferred embodiments of hazardous-environmental diving system 100 are preferably adapted to increase the safety of underwater divers operating in waters containing at least one hazardous material. Applicant's preferred dive apparatus is designed to generate and maintain a fully-protected breathing environment. Preferred embodiments of hazardous-environmental diving system 100, preferably including HMRSEDS 300, incorporate contaminate-resistant materials and physical configurations to limit the intrusion of hazardous materials, essentially forming a continuous protective barrier around the diver's breathing environment to limit the intrusion of such hazardous materials.

Preferred embodiments of hazardous-environmental diving system 100, preferably including HMRSEDS 300, preferably include dive equipment that is "factory hardened" to include such contaminate-resistant materials and physical configurations. In the present disclosure, the term "factory hardened" refers to apparatus supplied in ready-to-use form. Alternate preferred embodiments of hazardous-environmental diving system 100, are preferably generated by applying one or more specific modifications to an existing underwater dive system 101, preferably using a component-based kit system identified herein as Hazardous Environment Modification Assembly (HEMA) 102. HEMA 102 is preferably adapted to implement one or more risk-mitigating modifications to the diver-worn equipment of existing underwater dive system 101.

The initial sections of the present disclosure will discuss the retrofit modification of an existing underwater dive system 101. The later sections of the present disclosure will describe preferred apparatus supplied in a ready-to-use "factory hardened" configuration. It should be noted that a majority of the hardening features implemented by applicant's HEMA 102 are also implemented in the alternately preferred factory-hardened units; thus, a majority of the structures and arrangements presented in the initial sections of this disclosure are applicable to the factory-produced embodiments. In that regard, reference is now made to FIG. 1.

The following descriptions generally describe HMRSEDS 300 in terms of a full implementation of HEMA 102. Upon reading this specification, those with ordinary skill in the art will appreciate that, under appropriate circumstances, other system arrangements such as, for example, applying each of the below-described kit-based modifications separately, as indicated by a specific helmet design or severity of operational hazard, or implementation in whole, thus ensuring maximum protection of the diver during use, etc., may suffice. It is further noted that each of the below-described modifications enabled by HEMA 102 are intended to be installable by the end users of the underwater diving systems.

HMRSEDS 300, HEMA 102 is preferably used to convert a commercially available dive helmet 103 into a fully encapsulated protection system to isolate the diver from hazardous diving environment 111 containing hazardous materials 109. For general-use embodiments of hazardous-environmental diving system 100, a broad resistance to many types of chemical hazards is preferred, especially a resistance to chemicals that are most likely to be found in a waterway spill. Resistance to fuels and oils, industrial chemicals, biological agents, and acids and bases are noted examples of chemicals, which have been observed to degrade the helmet materials resulting in leaks or other detrimental changes in the helmet and its components.

The full range of potential hazardous materials 109 within hazardous diving environment 111 is extensive, frequently including chemicals, biological vectors, toxic industrial chemicals, toxic industrial materials (TIC/TIM) and potential chemical warfare agent (CWA) contaminates. Of special concern is that low contaminant concentrations in the breathing air system result in high partial pressures of the contaminant at working depths. Thus, even small amounts of hazardous materials 109 in the water, such as jet fuel or other chemical agents, can be toxic to divers submerged at working depth. An essential step in the protecting of a diver is to remove any pathway in which contaminants could enter the helmet or suit. The preferred embodiments of hazardous-environmental diving system 100 are preferably designed to modify existing underwater dive systems 101 with the intent of ensuring the maintenance of safe breathing environments during at least one operational duration.

HEMA 102 is a user-retrofittable kit preferably designed to retrofit at least one surface-supplied diving apparatus, identified herein as existing underwater dive systems 101. Prior to modification by HEMA 102, such diving apparatus is configured to supply breathing gas to the diver by way of supply umbilical 105 and for the breathing gas to be subsequently discharged directly into the surrounding hazardous diving environment 111 (without a surface return). Such existing underwater dive systems 101 preferably comprise at least one existing demand-type dive helmet 103, at least one existing surface-supplied breathing-gas subsystem 112, and at least one existing in-water exhaust subsystem 114 (shown in FIG. 1 removed from dive helmet 103).

Preferably, any significant operational safety and performance deficiencies, within the components of existing underwater dive systems 101, are identified and preferably corrected with one or more risk-mitigating modifications provided by integration in the preferred structures and arrangements of HEMA 102. Substantially all risk-mitigating modifications are preferably designed to protect the diver from the intrusion of hazardous materials 109 into the breathing environment for at least one predetermined operational duration, as further described below.

HEMA 102 is preferably designed to resolve at least two critical-risk issues present within existing underwater dive system 101. First, HEMA 102 addresses the movement of contaminants through material boundaries of the diver's breathing environment. Secondarily, HEMA 102 is preferably designed to eliminate back contamination of aerosols, fumes, and particulates generated from the in-water exhausting of breathing gas from existing in-water exhaust subsystem 114.

Testing by the applicant clearly demonstrated that the most commonly used existing underwater dive systems 101, as currently designed, do not adequately protect divers against the most common contaminants and solvents. Preferred test durations were designed to simulate operational durations of not less than 6 hours. Such testing preferably included both the demand supply regulator 107, internal exhaust valves, and related components of dive helmet 103. The testing identified multiple hazardous-material-caused failure points within existing underwater dive system 101 that resulted in at least one injurious introduction of hazardous materials 109 into the diver's breathing environment.

For example, permeability testing of the existing second-stage regulator diaphragm of demand supply regulator 107 (and associated parts) showed a serious failure of the Silicone materials when exposed to low molecular weight constituents of Jet A fuel, among other contaminants. In a diesel-fuel environment, the existing helmet systems experienced deterioration of the diaphragms and o-rings within 5-15 minutes. It is noted that breakthrough of carcinogenic compounds into the diver's breathing environment was observed to occur substantially concurrently with such failures.

In selecting appropriate replacement materials, applicant identified resistance to chemical attack and resistance to permeability as two primary considerations. As testing by applicant clearly illustrated, many customary helmet materials are vulnerable to direct chemical degradation. Testing also produced an unexpected finding; many materials can exhibit satisfactory resistance to direct chemical attach, but still allow the chemical to migrate through the composition, thus allowing a chemical pathway to compromise the diver's safety.

Materials identified in the testing and analysis to be especially susceptible to chemical attack and permeability where the existing soft-goods components 106 of dive helmet 103. These preferably include elastomeric (natural or synthetic rubber) O-rings, diaphragms, seals, gaskets, etc. As a result, HEMA 102 preferably comprises at least one soft-goods replacement package 120 preferably comprising a plurality of soft goods replacement parts for the soft (elastomeric) materials subjected to in-service contact with hazardous materials 109.

Elastomeric replacement components 110 of soft-goods replacement package 120 preferably comprise materials exhibiting equivalent mechanical characteristics to the original parts, with the added characteristic of low chemical permeability (thus reducing the permeation of hazardous materials 109 into the breathing gas).

Preferably, replacement components 110 of soft-goods replacement package 120 include one-to-one replacements of the existing Buna-N (nitrile rubber), neoprene, butyl, and silicon parts.

Typically, each commercial dive helmet 103 comprises a model-specific arrangement of existing soft-good components 106. To facilitate installation of replacement components 110, soft-goods replacement package 120 preferably comprises an equivalent "model-specific" set of replacement components 110. For example, in a highly preferred embodiment of HMRSEDS 300, existing underwater dive systems 101 preferably comprise a model 37 commercial dive helmet 103 produced by Kirby Morgan Dive Systems Inc. of Santa Maria, Calif. Preferred replacement components 110 of soft-goods replacement package 120 are preferably selected based to match the size, required quantity, and mechanical properties of the existing soft-goods components 106 of this helmet. Prior to modification, the model 37 helmet contains well over two dozen O-rings, gaskets, and seals. It is noted that specific helmet data, including exploded views and part schedules containing a full list of existing soft-good components 106 used within this and other preferred models, is publicly available for download by accessing the manufacturer's internet website (currently located at URL http://www.kirbymorgan.com).

Preferably, components of soft-goods replacement package 120 comprise one or more elastomers of low chemical permeability, good off-gassing characteristics, and appropriate mechanical properties. In addition, such hazardous-material-resistant compositions are preferably resistant to degraded physical performance by contact with hazardous materials 109, and transmission of hazardous quantities of hazardous materials 109 into the breathing environment by permeation of hazardous materials 109 through such hazardous-material-resistant elastomers.

Through extensive analysis and testing, applicant determined that a specific class of elastomeric materials produced replacement components 110 of superior performance. These replacement components 110 were preferably fabricated from a class of elastomers based on fluorine chemistry, preferably fluorocarbon elastomers based on fluorinated organic polymers having carbon-to-carbon linkages as the foundation of their molecular structures. These materials, generally identified in the art as fluoroelastomers (FKM), exhibit high chemical resistance, suitable mechanical properties, and acceptable material cost. The selected FKM materials were found to produce replacement components with substantially equivalent mechanical properties to those of the manufacturer's existing soft-goods components 106, thus maintaining critical performance specifications within the diving equipment. Materials comprising a range of fluoroelastomer chemistries may be selected to align with the required mechanical properties and or chemical resistance requirements of a specific replacement components 110. Preferred replacement components 110 of preferred embodiments of soft-goods replacement package 120 preferably included O-rings and diaphragms, seals, and gaskets. FKM sealants, caulking and coatings are also preferably used, as further described below.

In general, fluoroelastomer permeability is inversely proportional to the fluorine content of the material. Therefore, chemical permeability is also inversely proportional to material cost. A fluoroelastomer material, preferred for use in the development of a lower-cost soft-goods replacement package 120, preferably comprises commercially available Viton® products produced by DuPont Performance Elastomers L.L.C. of Wilmington, Del. The original commercial fluoroelastomer, Viton A, is preferred for general use in such a general purpose package.

Alternately preferably, a second fluoroelastomer material, preferred for use in the development of high-performance soft-goods replacement packages 120, preferably comprises replacement parts comprised of Kalrez® perfluoroelastomer, which is produced by DuPont Performance Elastomers L.L.C. Kalrez® demonstrated the lowest permeability and degradation rate of all materials tested by applicant, but also comprised a higher cost than Viton A. A demand regulator diaphragm comprising Kalrez® was found to have contributed only 12 parts per trillion of hydrocarbons to the breathing gas when diving in pure Jet A after 1,125 hours of testing. While the cost of Kalrez® is higher per installation, the reduced equipment rebuilding frequency is anticipated to more than compensate for the added initial cost. Table A of the specification provides a summary of preferred FKM materials and material sources for various replacement components 110 of soft-goods replacement packages 120. Upon reading the teachings of this specification, those of ordinary skill in the art will now understand that, under appropriate circumstances, considering such issues as intended use, nature of hazardous diving environment, etc., other elastomer selections, such as Xyfluor® (Green and Tweed), Dyneon® (by 3M), Nitrile, etc., may suffice.

TABLE A

| |
|---|
| DuPont PE: Viton Sheet (diaphragm material, etc.) |
| AAA Acme Rubber Co.: Viton sheet, custom molding, and other extrusions |
| Eagle Elastomer, Inc.: Viton Sheet and other extrusions |
| Parco Inc.: Viton custom molded parts and o-ring manufacturer |
| Simrit (Simrit USA): Viton custom molded parts and o-ring manufacturer |
| Fluorolast: Fluoroelastomer caulk and sealants |
| Pelseal ® Technologies, LLC: Fluoroelastomer caulks and sealants (Used to seal joints in the of dive helmet 103) |
| DuPont PE: Krytox performance lubricants. |

In popular commercial dive helmets, such as those produced by the Kirby Morgan Dive Systems, Inc. of Santa Maria, Calif., the existing face-port lens 131 is constructed of clear polycarbonate. This material has been identified as having a moderate to high potential for contaminate permeation and is easily damaged by contact with a number of hazardous materials 109. Therefore, preferred embodiments of HEMA 102 further preferably comprise at least one optical-faceplate covering 133 structured and arranged to substantially cover existing face-port lens 131, as shown. Preferably, optical-faceplate covering 133 comprises at least one hazardous-material-resistant material substantially resistant to degraded physical performance by contact with hazardous material 109 and introduction of hazardous levels of hazardous material 109 into the breathing environment by permeation.

Preferably, optical-faceplate covering 133 comprises sufficient transparency as to maintain a level of optical viewing through the existing face-port lens 131. Most preferably, optical-faceplate covering 133 comprises a sheet of glass material laminated to the exterior surface of the existing face-port lens 131.

Surface-supplied breathing-gas subsystem 112 preferably comprises supply control station 116 and supply umbilical 105, as shown. A typical supply umbilical 105 preferably consists of a ⅜" (minimum) breathing-gas supply hose 122, a ¼" pneumofathometer hose, and a communication cable. Critical components of supply umbilical 105 having a potential hazardous-material-caused failure include the rubber or synthetic composition of the existing breathing-gas supply hose 122. Such hoses comprise a similar susceptibility to certain hazardous materials 109 as do the soft goods of dive helmet 103, including permeation of hydrocarbons into the breathing air supply. To mitigate the risk of chemical intrusion, HEMA 102 preferably comprises at least one chemical-resistant hose covering 118 structured and arranged to cover the existing breathing-gas supply hose of supply umbilical 105. Preferably, chemical-resistant hose-covering 118 is structured and arranged to maintain the functional integrity of the existing breathing-gas supply hose 122 (within the intended operational duration). Most preferably, chemical-resistant hose-covering 118 comprises at least one flouroelastomer sheath 124 wrapped around existing breathing-gas supply hose 122 and sealed with flouroelastomer sealant 126, as shown. Upon reading the teachings of this specification, those of ordinary skill in the art will now understand that, under appropriate circumstances, considering such issues as cost, intended use, etc., other supply-hose arrangements, such as the use of umbilical hoses comprising chemical resistant fluoroelastomers, the use of other protective surface coatings, etc., may suffice.

Preferably, supply control station 116 comprises a commercially available unit providing a control point for a topside operator (tender) and one or more surface-supported divers. Diving control station 116 preferably comprises provisions for the control of the supply of breathing gas, diver depth monitoring, and voice communications. Preferably, supply control station 116 is located outside of hazardous diving environment 111, such as, for example, at the surface of the water, in a diving bell, or in a submerged habitat within hazardous diving environment 111. The breathing gas supplied by standard umbilical 105 preferably comprises air or other gas mixtures (e.g. helium/oxygen, etc.). A preferred commercial supply control station suitable for use as supply control station 116 includes the Kirby Morgan model KMACS-5.

HEMA 102 further comprises a preferred means for eliminating back contamination of aerosols, fumes, and particulates entering from the in-water exhausting of breathing gas from existing in-water exhaust subsystem 114. This preferred risk-mitigating modification is preferably achieved by removal of the existing in-water exhaust subsystem 114 and replacement with Regulated Surface Exhaust (RSE) assembly 104, as described below.

Figure 2:
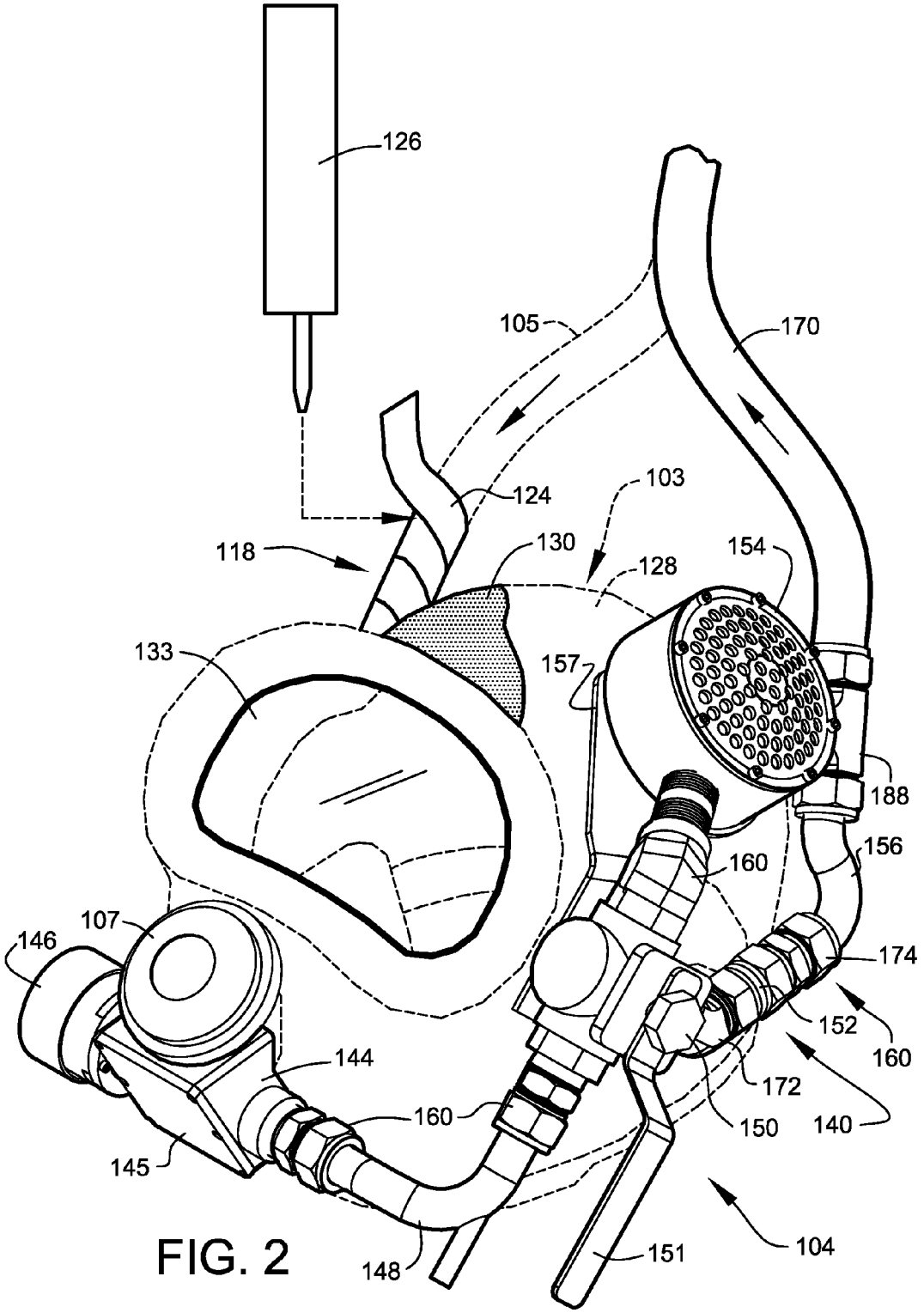
FIG. 2 shows a perspective view illustrating an existing dive helmet modified to comprise a hazardous environment modification assembly, according to a preferred embodiment of the present invention.
Figure 3:
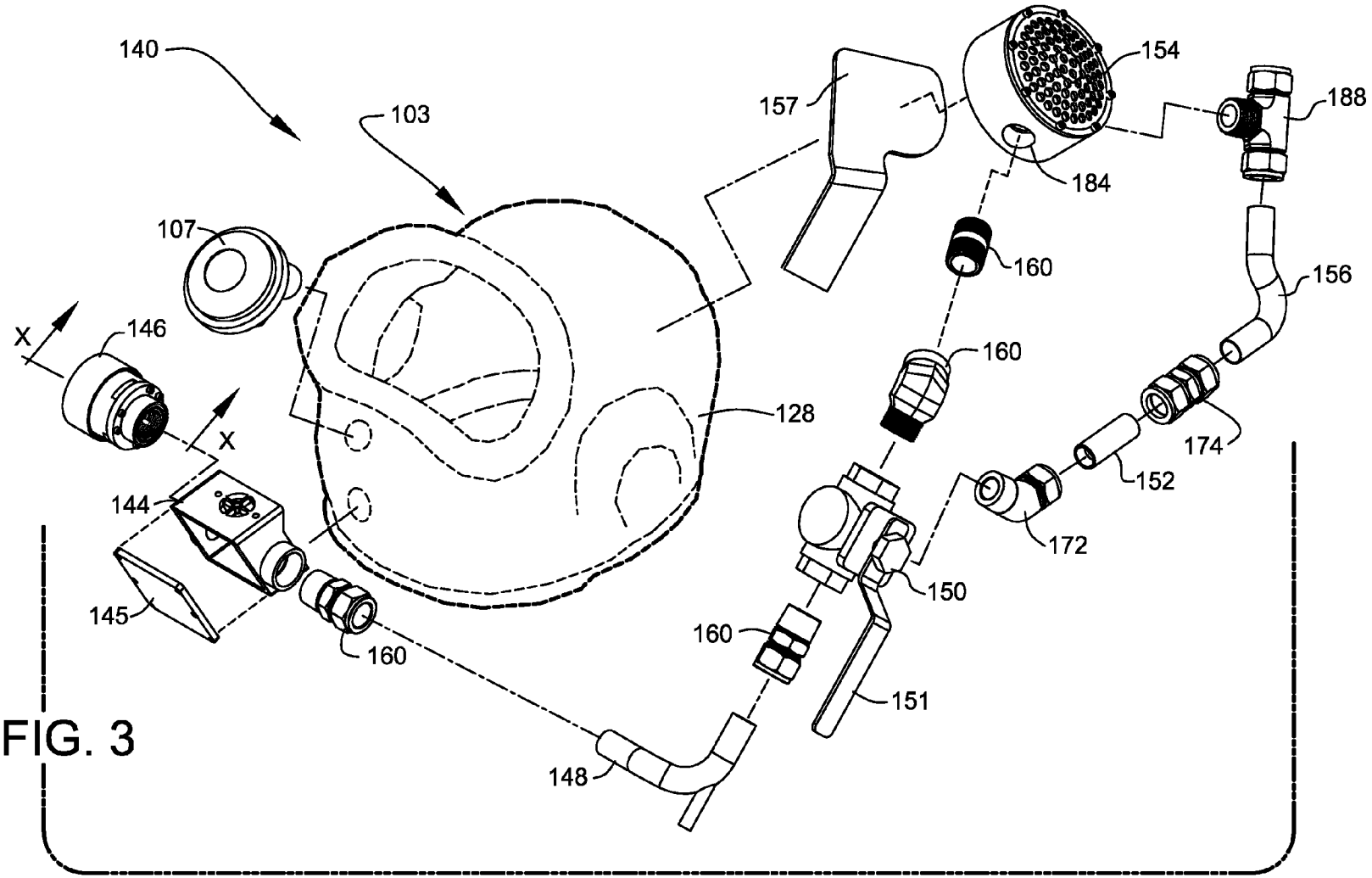
FIG. 3 shows an exploded perspective view, illustrating preferred subcomponents of the hazardous environment modification assembly including a return surface exhaust assembly, according to the preferred embodiment of FIG. 1.

FIG. 2 shows a perspective view illustrating an existing dive helmet 103 modified to comprise HEMA 102, according to a preferred embodiment of the present invention. FIG. 3 shows an exploded perspective view, illustrating preferred hardware components of HEMA 102, according to the preferred embodiment of FIG. 1.

Preferably, dive helmet 103 comprises an existing commercial dive helmet, or alternately preferably, an equivalent military version. Such existing dive helmets preferably include, for example, the model SuperLite®-17B (and the U.S. Navy version of the commercial Kirby Morgan superlite 17B helmet known as the MK-21), the larger Kirby Morgan® 37, and the SuperLite®-27, each produced by Kirby Morgan Dive Systems, Inc. of Santa Maria, Calif. The Kirby Morgan dive helmets are among the most widely used designs in surface-supplied diving operations and are considered standard dive equipment in the commercial diving industry.

As noted previously, testing of the unmodified MK-21 helmets failed to prevent intrusion of water when a diver's head moved from the upright position at any operational depth, despite being equipped with an in-water exhaust subsystem 114 having a double exhaust valve. Contamination of the breathing environment within the helmet often results in reduced dive duration, at a minimum, and may result in immediate abort due to equipment failure (due to material deterioration). Furthermore, the inhalation of contaminated microscopic water droplets from the exhaust circuit of the existing in-water exhaust subsystem 114 provides a direct passage of the contaminant to the diver's lungs, and thus to the bloodstream.

The retrofitting of RSE assembly 104 preferably eliminates in-water exhaust subsystem 114 by returning the exhaled breathing gas to the surface, absolutely preventing back contamination by aerosols, fumes, particulates, etc. In addition, this preferred risk-mitigating modification allows for continuous monitoring of the exhaust gas for indications of a breach in any part of the now fully sealed and isolated breathing gas system.

The following descriptions provide a general overview of the removal of in-water exhaust subsystem 114, preparation of dive helmet 103 for retrofitting, and installation of RSE assembly 104 to dive helmet 103.

The outer shell 128 of dive helmet 103 is the central structure for mounting all the components that make up the complete helmet. The preferred Kirby Morgan helmets described herein are generally designed to allow easy replacement of parts, making the retrofitting of the helmet, using the preferred kit embodiments described herein, within the capabilities of individuals of ordinary skill in the art.

The preferred outer shell 128 comprises a lightweight glass-fiber reinforced thermal setting polyester (fiberglass) with carbon fiber reinforcements and a gel coat finish. Alternately preferably, outer shell 128 may comprise a non-corrosive metal composition (such as provided within the stainless steel Kirby Morgan 77 helmet).

Depending on the permeability of the outer shell 128, an additional chemical-resistant coating 130 may be applied to outer shell 128 during preferred retrofit preparation procedures (at least embodying herein at least one helmet coating structured and arranged to coat at least one possibly-permeable outer-shell-portion of the at least one existing dive helmet, wherein such at least one helmet-coating is further structured and arranged to reduce transmission of hazardous quantities of the at least one hazardous material into the at least one breathing environment by reducing contact interaction between the at least one hazardous material and the at least one possibly-permeable outer-shell-portion of the at least one existing dive helmet).

Preferably, the standard side-block valve-assembly 132, bent tube 134, and demand supply regulator 107 of dive helmet 103 are retained in the preferred embodiments of hazardous-environmental diving system 100 (see FIG. 1). Preferably, each of the above-described components are modified, preferably using appropriate FKM components of soft-goods replacement package 120, to replace any existing soft-goods components 106 identified as being incompatible with operation in hazardous diving environment 111. These modifications specifically include the replacement of the existing silicone regulator diaphragm of demand supply regulator 107 (and associated parts) with an FKM equivalent replacement component 110. In addition, as part of a preferred retrofit procedure, the standard side-block valve-assembly 132, bent tube 134, and demand supply regulator 107 may be removed from outer shell 128 to allow for the replacement of standard silicone "pass-through" sealants with an appropriate flouroelastomer sealant 126, preferably at least one room temperature-cured flouroelastomer (at least embodying herein at least one replacement sealant structured and arranged to replace existing sealants of the at least one existing commercial dive system, wherein such at least one replacement sealant is structured and arranged to reduce transmission of hazardous quantities of the at least one hazardous material into the at least one breathing environment of the at least one existing dive helmet by permeation of the at least one hazardous material through such at least one replacement sealant, and wherein such at least one replacement sealant comprises at least one room temperature-cured flouroelastomer-based composition).

The chemically-hardened side-block valve-assembly 132 preferably retains the functions of receiving the main gas supply flow from supply umbilical 105, supporting at least one non-return valve, providing fittings/controls for an emergency gas supply, providing fittings/controls for ventilation and defogging (supplying a flow of air to the helmets air train assembly), and provides a pathway for breathing gas routed to the chemically-hardened demand supply regulator 107. The chemically-hardened demand supply regulator 107 preferably retains the function of sensing the start of the diver's inhalation and opening the supply regulator diaphragm (essentially on demand) to inlet the breathing gas to the oral-nasal mask within the helmet.

In an unmodified helmet, as the diver exhales, the supply regulator diaphragm of demand supply regulator 107 closes causing the exhalation gas to flows through the regulator exhaust and the helmet exhaust into exhaust subsystem 114. Exhaust subsystem 114 (preferably comprising the Kirby Morgan Quad-Valve™ exhaust assembly) is designed to route the exhaust of demand supply regulator 107 and the helmet main exhaust to either one of two (or both) exhaust valves that are part of the bubble deflecting whiskers, and out into the water. Additional information relating to the Kirby Morgan Quad-Valve™ exhaust assembly is presented in Kirby Morgan Document 071031002, publicly available for download at manufacturer's internet website (URL http://www.kirbymorgan.com).

As empirical testing demonstrated the inability of exhaust subsystem 114 to fully eliminate back contamination during operation, it is preferred that exhaust subsystem 114 be completely removed from the breathing system of dive helmet 103 (as shown in FIG. 1). The return-to-surface exhaust functions provided by RSE assembly 104 preferably replaces the in-water exhaust functions eliminated by the removal of exhaust subsystem 114. Detailed instructions for the removal of exhaust subsystem 114 is presented in Kirby Morgan Document #071031002, Chapter 7.0 entitled "Breathing System Maintenance and Repairs".

Preferably, the retrofitting of RSE assembly 104 to dive helmet 103 converts existing underwater dive system 101 to a closed-circuit breathing system whereby the diver's exhausted gas is returned to the surface and exhausted to the atmosphere rather than exhausting into the water. The above-described modifications at least embody herein at least one in-water-exhaust disabler structured and arranged to disable the at least one existing in-water exhaust subsystem (by means of removal), and at least one surface-return exhaust subsystem structured and arranged to exhaust breathing gas from the at least one breathing environment of the at least one existing dive helmet to the surface (wherein at least one entry path for inhalable amounts of the at least one hazardous material may be removed).

It is again noted that the term "surface" shall include breathable atmospheres outside hazardous diving environment 111, such as the surface of the water, a diving bell, or a submerged habitat within hazardous diving environment 111.

Figure 4:
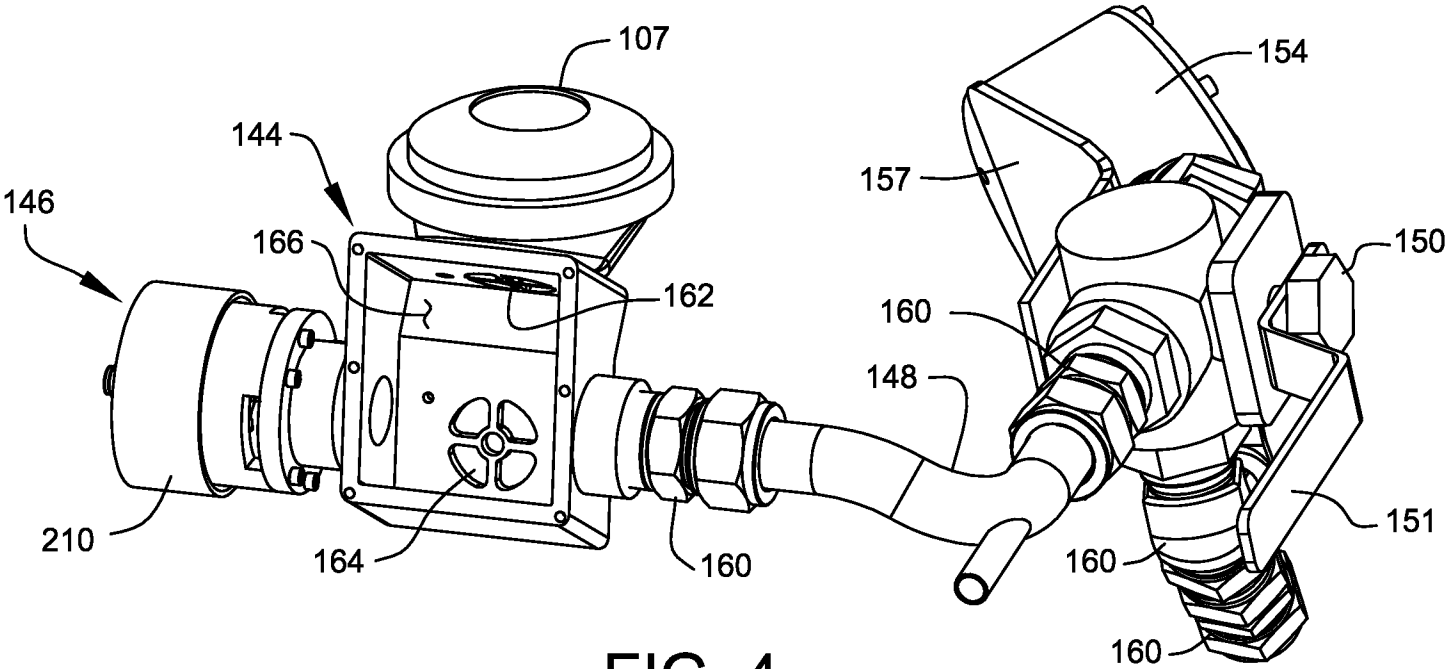
FIG. 4 shows a perspective view, illustrating the return surface exhaust assembly (apart from the dive helmet) according to the preferred embodiment of FIG. 1.

FIG. 4 shows a perspective view, illustrating RSE assembly 104 of HEMA 102 (apart from the dive helmet) according to the preferred embodiment of FIG. 1. Reference is now made to FIG. 4 with continued reference to FIG. 1 through FIG. 3.

RSE assembly 104 preferably comprises two component assemblies generally identified herein as helmet-mounted subassembly 140 and surface-return subassembly 142, as shown (see also FIG. 1). Helmet-mounted subassembly 140 preferably comprises exhaust plenum 144, exhaust plenum cover plate 145, emergency dump valve 146, first connector tube 148, three-way bypass valve 150, bypass flow fuse 152, Demand Exhaust Regulator (DER) 154, and second connector tube 156, as shown. In addition, helmet-mounted subassembly 140 preferably comprises support plate 157 to support DER 154 from outer shell 128 and a plurality of connector fittings 160 adapted to couple the various components within the exhaust flow path. It is noted that exhaust plenum cover plate 145 has been omitted from the view of FIG. 4 to assist in the description of the interior arrangements of exhaust plenum 144. In an alternate preferred embodiment of helmet-mounted subassembly 140, to reduce the potential for leakage, all connector tubing between exhaust plenum 144 and breathing-gas return hose 170 comprises welded fittings.

Preferably, exhaust plenum 144 is designed to couple the existing regulator exhaust port 162 of demand supply regulator 107 with the existing helmet main exhaust 164 within a single plenum chamber 166 (at least embodying herein at least one exhaust coupler structured and arranged to operably couple such at least one demand-based exhaust regulator to the at least one breathing environment of the at least one existing dive helmet), as shown. Exhaust plenum 144 is preferably mounted between demand supply regulator 107 and main exhaust body (Kirby Morgan part number 123 of the model 37 helmet of Kirby Morgan Document #07080003). Preferably, the upper wall of exhaust plenum 144 mates to the regulator exhaust flange of demand supply regulator 107, as shown. The rear wall of exhaust plenum 144 preferably mates to the main exhaust body of the helmet, as best shown in FIG. 2. Preferably, one or more flouroelastomer sealing materials are used to seal exhaust plenum 144 to the adjacent structures. Preferably, both emergency dump valve 146 and first connector tube 148 mount to exhaust plenum 144 and are preferably in fluid communication with plenum chamber 166, as shown.

Preferably, emergency dump valve (EDV) 146 is structured and arranged to provide emergency pressure relief due to over pressurization of the helmet (or emergency exhaust to ambient due to catastrophic failure of the return system). The preferred structures and features of EDV 146 are further described in FIG. 10 and FIG. 11.

In normal operation, exhaust gases preferably exit plenum chamber 166 through first connector tube 148 and are preferably conducted to three-way bypass valve 150, as shown. Preferably, three-way bypass valve 150 (at least embodying herein at least one gas-flow control valve) is structured and arranged to control the routing of the exhaust gas between the breathing environment of dive helmet 103, DER 154, and at least one surface-return hose 170 of surface-return subassembly 142 (see also FIG. 1).

Preferably, a diver at depth can set three-way bypass valve 150 to one of three operational settings using handle 151. Preferably, three-way bypass valve 150 comprises a normal-operational setting to enable exhausting of the breathing gas from the breathing environment of dive helmet 103 through DER 154. In addition, three-way bypass valve 150 preferably comprises a free-flow setting to enable exhausting of the breathing gas from dive helmet 103 directly to surface-return hose 170 without passage through DER 154. This setting may be selected by the diver in the event of a failure of DER 154. The third flow setting preferably disables the return-to-surface exhaust circuit by isolating the dive helmet 103 from both DER 154 and surface-return hose 170. The diver, in the event of a significant failure of the surface return exhaust system, may select this setting to prevent a dangerous loss of pressure within the helmet. In the third setting, exhausting of the breathing gas preferably occurs substantially entirely through EDV 146.

In the free-flow setting, second connector tube 156 preferably functions as a means for conducting the exhaust gas diverted by three-way bypass valve 150 directly to surface-return hose 170, as shown. Bypass flow fuse 152 is preferably located "in-line" with the exhaust flow of second connector tube 156 and is preferably positioned between 45-degree compression adapter 172 and coupling 174, as shown. Preferably, bypass flow fuse 152 is adapted to inhibit sudden rapid gas flow as a result of the development of a sudden pressure differential, across the fuse, which exceeds preset limits. Such a pressure differential may be a result of a downstream component failure within surface-return subassembly 142, such as a line rupture within surface-return hose 170. Bypass flow fuse 152 is essentially a check valve preferably installed in between dive helmet 103 and surface-return hose 170 to immediately inhibit flow upon sensing a pressure differential across the fuse that exceeds the setpoint.

The exhaust pathway extending from exhaust plenum 144 preferably comprises a minimum cross-sectional diameter of about ¾ inch. This preferred minimum diameter was found to assist in maintaining acceptable levels of resistive breathing effort within the overall system (substantially equivalent to the original in-water exhaust arrangements).

Figure 5:
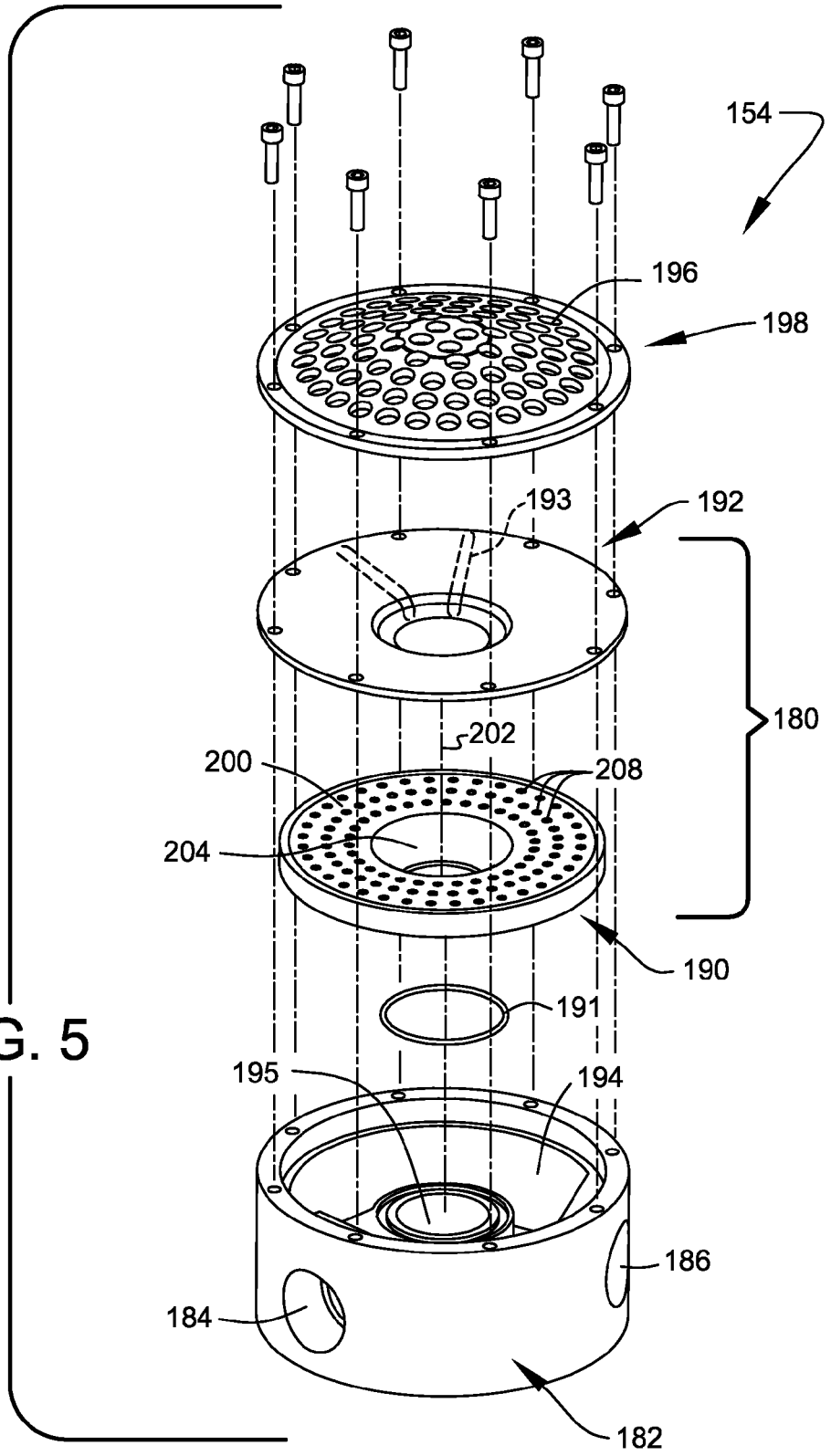
FIG. 5 shows an exploded perspective view of the Demand Exhaust Regulator (DER) according to the preferred embodiment of FIG. 1.
Figure 6A:
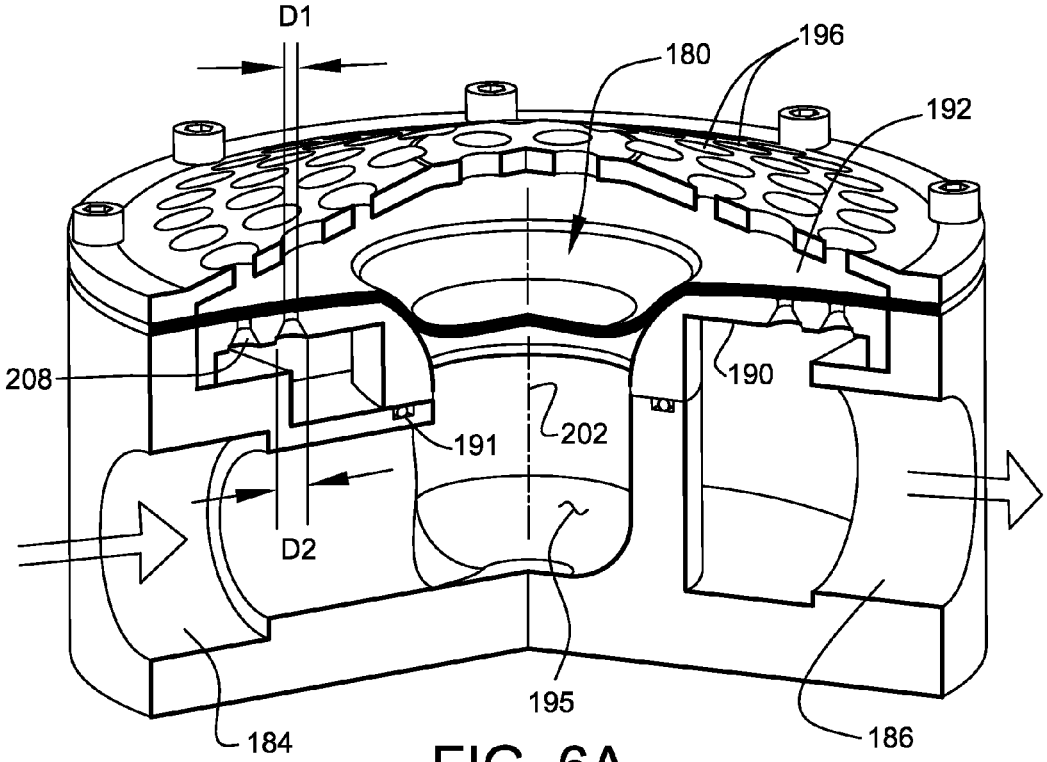
FIG. 6A shows a perspective view, in partial section, of the Demand Exhaust Regulator (DER), according to the preferred embodiment of FIG. 1.
Figure 6B:
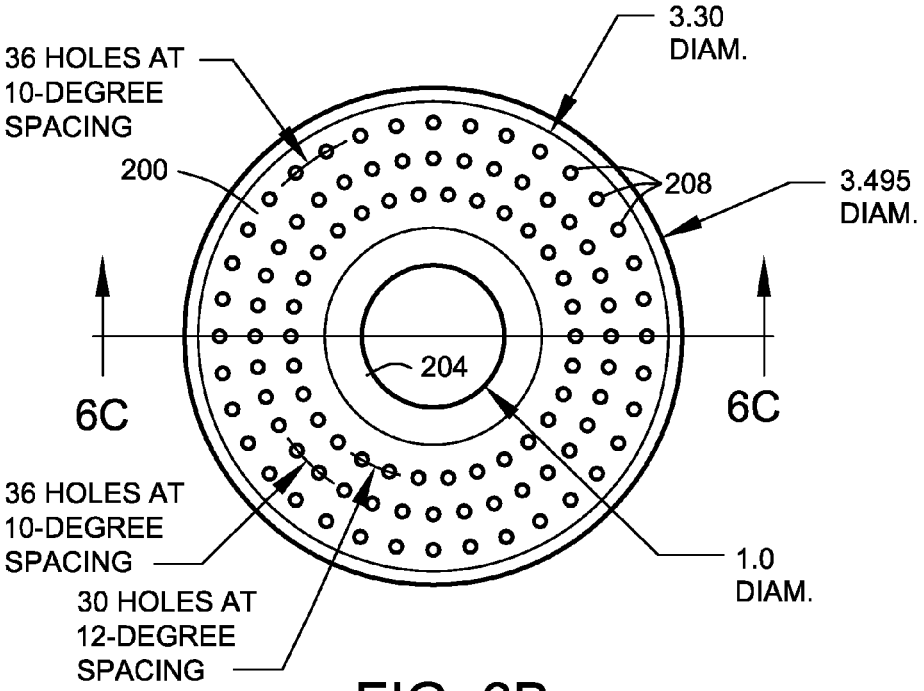
FIG. 6B shows a top view of a preferred valve seat of the Demand Exhaust Regulator of FIG. 6A.
Figure 6C:
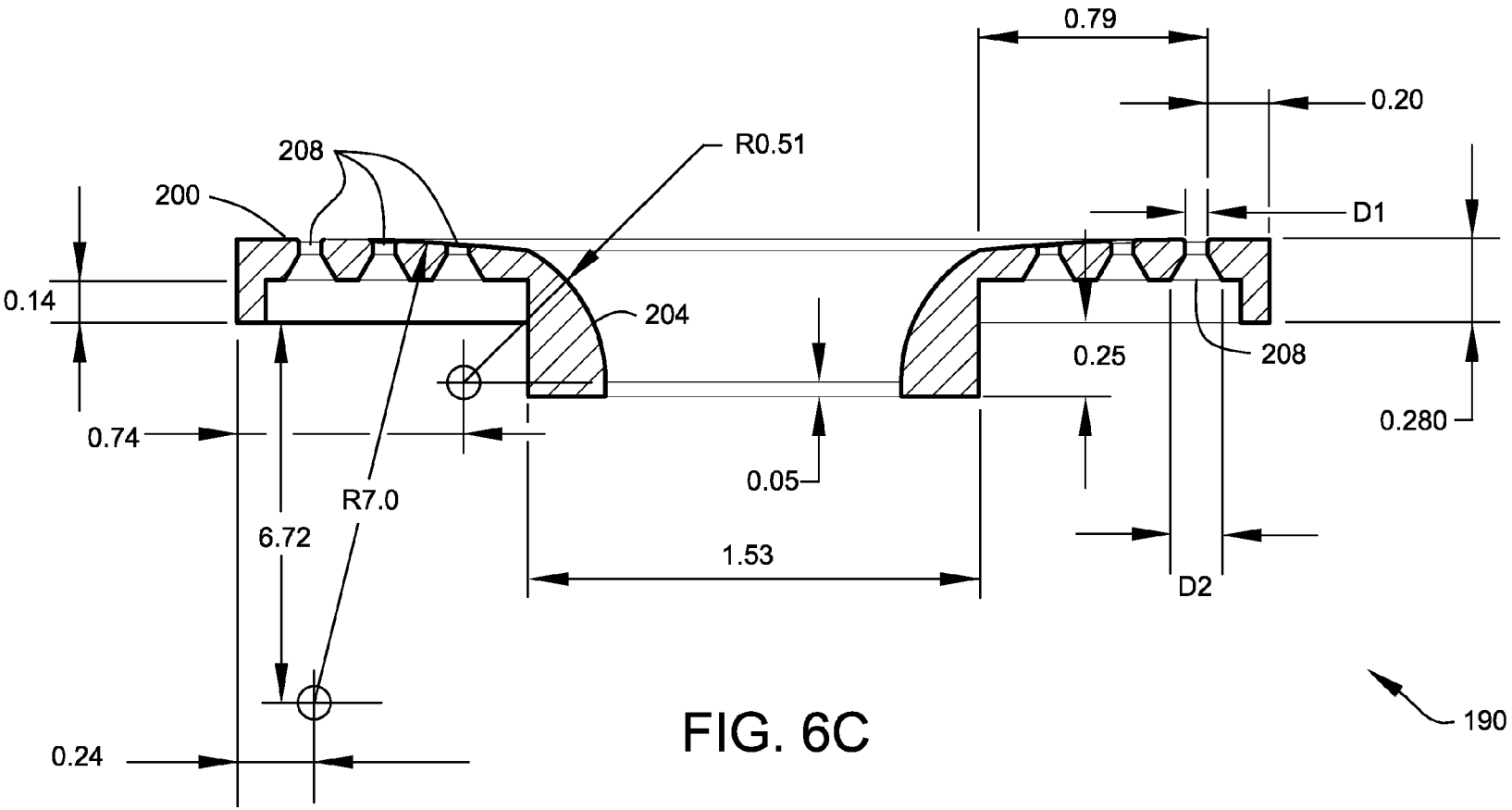
FIG. 6C shows a sectional view through the section 6C-6C of FIG. 6B illustrating preferred arrangements of the valve seat of FIG. 6A.
Figure 9:
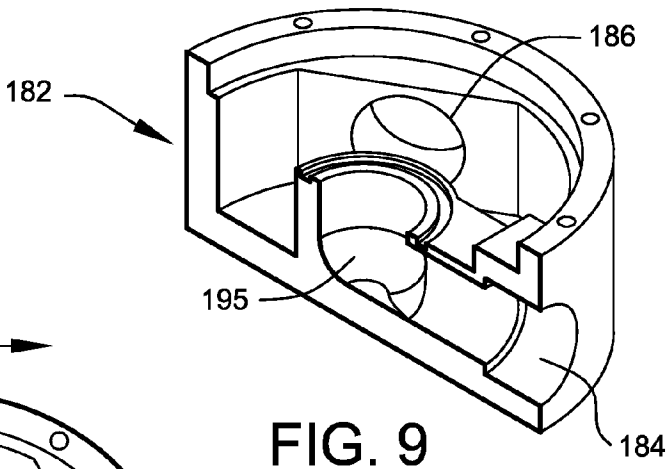
FIG. 9 shows a sectional view through the section 9-9 of FIG. 8.
Figure 8:
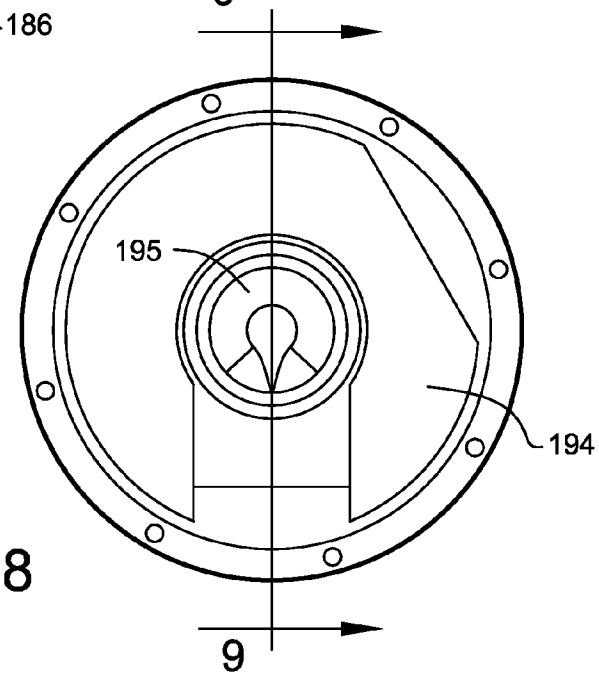
FIG. 8 shows a top view of the valve body of FIG. 7.
Figure 7:
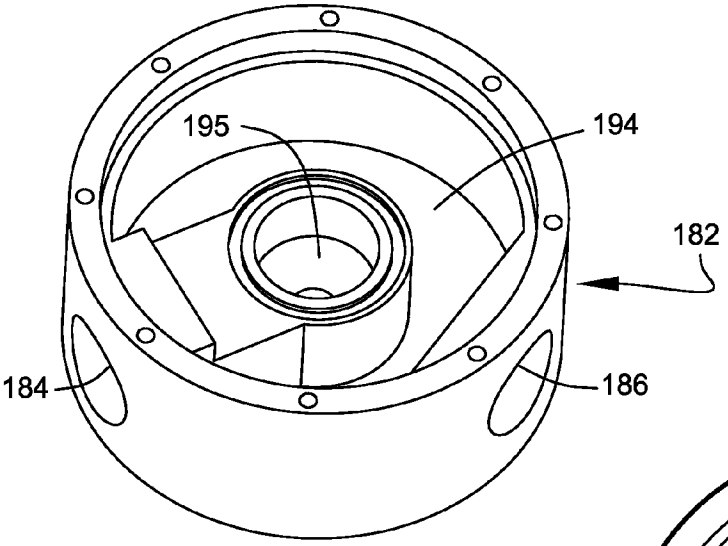
FIG. 7 shows a perspective view, of a valve body of the Demand Exhaust Regulator (DER), according to the preferred embodiment of FIG. 1.

FIG. 5 shows an exploded perspective view of DER 154 according to the preferred embodiment of FIG. 1. FIG. 6 shows a perspective view, in partial section, of DER 154. FIG. 7 shows valve body 172 of DER 154. FIG. 8 shows a top view of valve body 172. FIG. 9 shows a sectional view through the section 9-9 of FIG. 8.

DER 154 preferably functions as a pressure-actuated valve that enables controlled exhaust from helmet-mounted subassembly 140 to surface-return subassembly 142. DER 154 preferably comprises a generally cylindrical valve housing 182 preferably adapted to house at least one internal demand-based valve assembly 180, as shown. Preferably, demand-based valve assembly 180 is structured and arranged to control, essentially on demand, passage of the breathing gas through DER 154, thus maintaining a relatively static pressure equilibrium within dive helmet 103. Demand-based valve assembly 180 preferably comprises a generally circular valve seat 190 and exhaust diaphragm 192 in a superimposed placement adjacent valve seat 190, as shown.

Valve housing 182 preferably comprises inlet duct 184 to inlet the breathing gas exhausted from dive helmet 103 (preferably via exhaust plenum 144, first connector tube 148, and three-way bypass valve 150 respectively). Inlet duct 184 of valve housing 182 is preferably arranged to conduct the exhausted breathing gases from a side-positioned entry point on valve housing 182, turning upward through central bore 195 to the internally located demand-based valve assembly 180, as shown. Valve housing 182 preferably comprises a corresponding outlet duct 186 to outlet the exhausted breathing gases, from the interior of valve housing 182 after controlled passage through demand-based valve assembly 180.

Valve seat 190 is preferably disposed between inlet duct 184 and outlet duct 186 and preferably forms the upper portion of central bore 195, as shown. Preferably, valve seat 190 comprises a circumferential sealing surface 200 extending radially outward from central axis 202 of central bore 195, as shown. The upper portion of central bore 195 preferably comprises a smooth transition-surface 204 preferably forming a smoothly sweeping transition between central bore 195 and the circumferential sealing surface 200, as shown. Preferably, all surfaces contacting exhaust diaphragm 192 are smoothed to reduce contact wear on exhaust diaphragm 192 during operation.

Preferably, valve seat 190 is removably mounted within valve housing 182, as shown. Valve seat 190 is preferably sealed to valve housing 182 using at least one flouroelastomer O-ring 191, as shown, preferably a Viton O-ring part number 1201T38 by McMaster-Carr of Chicago, Ill. Preferably, both valve seat 190 and the overlying exhaust diaphragm 192 are captured within valve housing 182 by DER cover 198, as shown. Preferably, DER cover 198 is mechanically fastened to valve housing 182, as shown, preferably using about eight threaded fasteners, preferably type 316 stainless steel socket head cap screws 6-32 thread, ½" length, part number 92185A148 by McMaster-Carr of Chicago, Ill. Preferably, the entire peripheral edge of exhaust diaphragm 192 is fully sealed to valve housing 182 to fully isolate the exhaust pathway from the ingress of contaminants originating within hazardous diving environment 111, as shown.

A circumferential plenum chamber 194 is preferably formed within the interior of valve housing 182, generally below valve seat 190, and is preferably in fluid communication with outlet duct 186, as shown.

Preferably, sealing surface 200 is structured and arranged to form at least one pressure seal with exhaust diaphragm 192, as shown. Sealing surface 200 preferably comprises a plurality of gas-conducting passages 208, each one structured and arranged to enable passage of the breathing gas from inlet duct 184, through valve seat 190, and into plenum chamber 194, as shown.

Exhaust diaphragm 192 is preferably arranged within valve housing 182 to be in contemporaneous pressure communication with inlet duct 184, outlet duct 186 and ambient water pressure, the latter preferably by means of aperture openings 196 within removable DER cover 198, as shown. Preferably, exhaust diaphragm 192 is flexibly movable between at least one flow-blocking position, substantially engaging sealing surface 200, as shown, and at least one flow-delivery position preferably disengaging sealing surface 200.

Preferably, while in such flow-blocking position, exhaust diaphragm 192 substantially blocks the passage of the breathing gas through gas-conducting passages 208, as shown. Preferably, while in such flow-delivery position, exhaust diaphragm 192 enables the passage of the breathing gas from inlet duct 184 through gas-conducting passages 208 to plenum chamber 194 and outlet duct 186.

The above-described operation of demand-based valve assembly 180 is preferably enabled by exhausting of the breathing gas by the diver. As the diver exhales, a pressurizing bias force is preferably applied to exhaust diaphragm 192 flexibly moving at least one portion of exhaust diaphragm 192 from the flow-blocking position to the flow-delivery position.

Preferably, each gas-conducting passage 208 comprises a hollow frustoconical aperture, as shown. Preferably, each frustoconical aperture comprises a small inlet diameter D1 and a larger outlet diameter D2, as shown. Preferably, the small inlet diameter D1 is structured and arranged to minimize unsupported areas of the exhaust diaphragm material when exhaust diaphragm 192 is in the flow-blocking position. This preferably allows the use of relatively thin diaphragm thicknesses, with a corresponding reduction in the required cracking force. The larger outlet diameter D2 preferably functions to beneficially optimize mass flow through gas-conducting passage 208 and valve seat 190. Sealing surface 200 preferably comprises a radial arrangement of 102 gas-conducting passages 208 preferably comprising a diameter D1 of about 0.07 inches and a diameter D2 formed by a 60° chamfer cut into the underside of valve seat 190 to a depth of about 0.09 inches. Preferably, the upper edge of diameter D1 is eased by applying a 45° chamfer a depth of about 0.01 inches. Valve seat 190 is preferably constructed from 316 stainless steel. FIG. 6B shows a top view of valve seat 190 of DER 154. FIG. 6C shows a sectional view through the section 6C-6C of FIG. 6B illustrating preferred arrangements of valve seat 190. All dimensions within FIGS. 6B and 6C are in inches unless noted otherwise.

Preferably, exhaust diaphragm 192 is structured and arranged to generally conform to the surface geometry of sealing surface 200, when so engaged. More preferably, exhaust diaphragm 192 is molded to substantially match the shape of sealing surface 200 and valve seat 190, as shown. Preferably, exhaust diaphragm 192 is substantially radially symmetrical about central axis 202, as shown. Alternate preferred embodiments of exhaust diaphragm 192 comprise a pair of ribs 193, located axially on the upper (non-sealing) surface of the diaphragm, to allow for eccentric bending, thus reducing the required cracking pressure (at least embodying herein at least one asymmetrical stiffener structured and arranged to structurally stiffen at least one portion of such at least one diaphragm, wherein such asymmetrical structural stiffening reduces the level of pressure forces required to flexibly move such at least one portion of such at least one flexible diaphragm from such at least one flow-blocking position to such at least one flow-delivery position). As with all soft goods of HEMA 102, exhaust diaphragm 192 preferably comprises a flouroelastomer, preferably at least one Viton product. Preferably, exhausted breathing gases exiting outlet duct 186 are subsequently routed through tee fitting 188 to surface-return hose 170 of surface-return subassembly 142, as shown in FIG. 2.

Preferably, DER 154 is mounted to support plate 157 that is preferably supported from outer shell 128, as shown. Upon reading the teachings of this specification, those of ordinary skill in the art will now understand that, under appropriate circumstances, considering such issues as intended use, cost, etc., other demand valve arrangements, such as variable pressure swing valves, variable pressure piston valves, swing arm valve assemblies, conventional demand valves, etc., may suffice.

Figure 10:
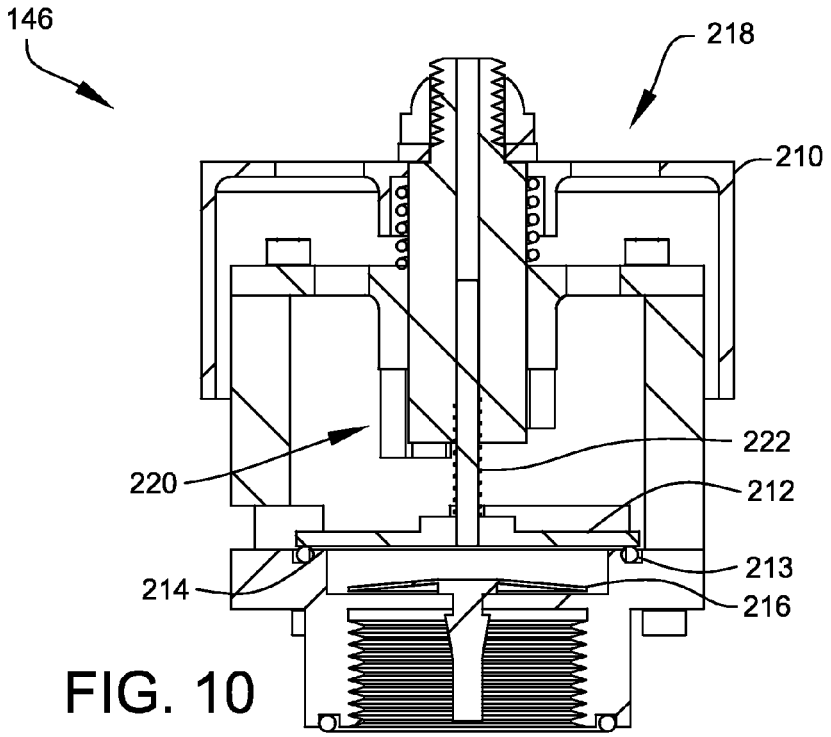
FIG. 10 shows a sectional view, through the section X-X of FIG. 3, illustrating an emergency dump valve in a normal operating configuration.
Figure 11:
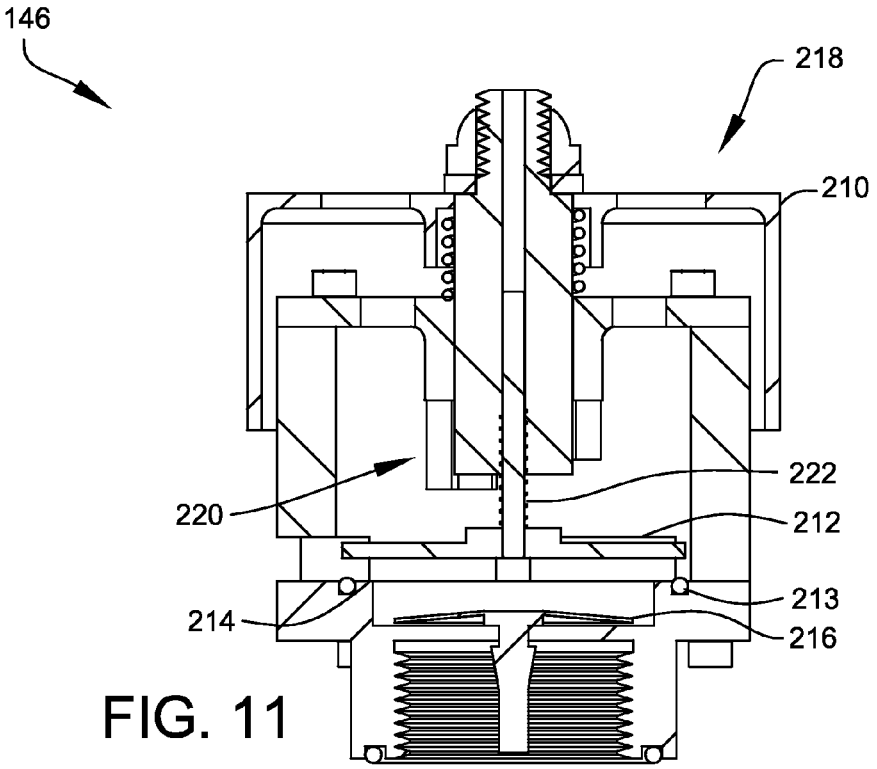
FIG. 11 shows a sectional view, through the section X-X of FIG. 3, illustrating the emergency dump valve in an emergency configuration.

FIG. 10 shows a sectional view, through the section X-X of FIG. 3, illustrating the internal configuration of EDV 146 in normal mode. FIG. 11 shows a sectional view, through the section X-X of FIG. 3 illustrating the internal configuration of EDV 146 in emergency mode. In normal mode, EDV 146 is adapted to exhaust at about 10 inches of $H_2O$ above ambient pressure. In emergency mode, EDV 146 is adapted to exhaust at about 1 inch of $H_2O$ above ambient. Preferably, transition between normal mode and emergency mode is user selectable by a diver at depth.

Manual operation preferably occurs by the diver grasping the furthermost, outmost external portion 210 of the valve assembly and pushing toward dive helmet 103, while simultaneously turning in a clockwise direction, then releasing. Preferably, the diver can allow all helmet pressure to be relieved through EDV 146, if the surface return system malfunctions, allowing the diver time to reach safety or to correct the problem causing the off-nominal operation.

When EDV 146 is set to emergency mode, valve-inhibiting member 212 is preferably moved away from O-ring 213 of valve seat 214 allowing one-way exhaust valve 216 to operate freely, (whereas it was previously biased to the closed position by the pressure engagement of the valve-inhibiting member), as shown. Valve-inhibiting member 212 is preferably held under pressure by spring-loaded assembly 218 that can be engaged and disengaged by pushing and rotating bayonet-style lock 220 to at least one closed and open position. By pushing and turning in a first direction, valve-inhibiting member 212 is put into operation and by pushing and turning in a second direction, valve-inhibiting member 212 becomes inoperative.

Preferably, valve-inhibiting member 212 also functions as a pressure relief valve. Preferably, EDV valve 146 is automatically opened by an increase in pressure within dive helmet 103 above the cracking pressure of valve-inhibiting member 212. This air pressure overcomes the spring pressure of secondary spring 222 of valve-inhibiting member 212, thus allowing valve-inhibiting member 212 to be moved away from its closed position long enough for the air pressure in dive helmet 103 to vent to the ambient pressure of the water. Preferably, valve-inhibiting member 212 returns to its closed position when the internal pressure of the helmet can no longer overcome the pressure of secondary spring 222. Preferably, the automatic venting process of EDV 146 can repeat indefinitely until interrupted by another process.

Figure 12:
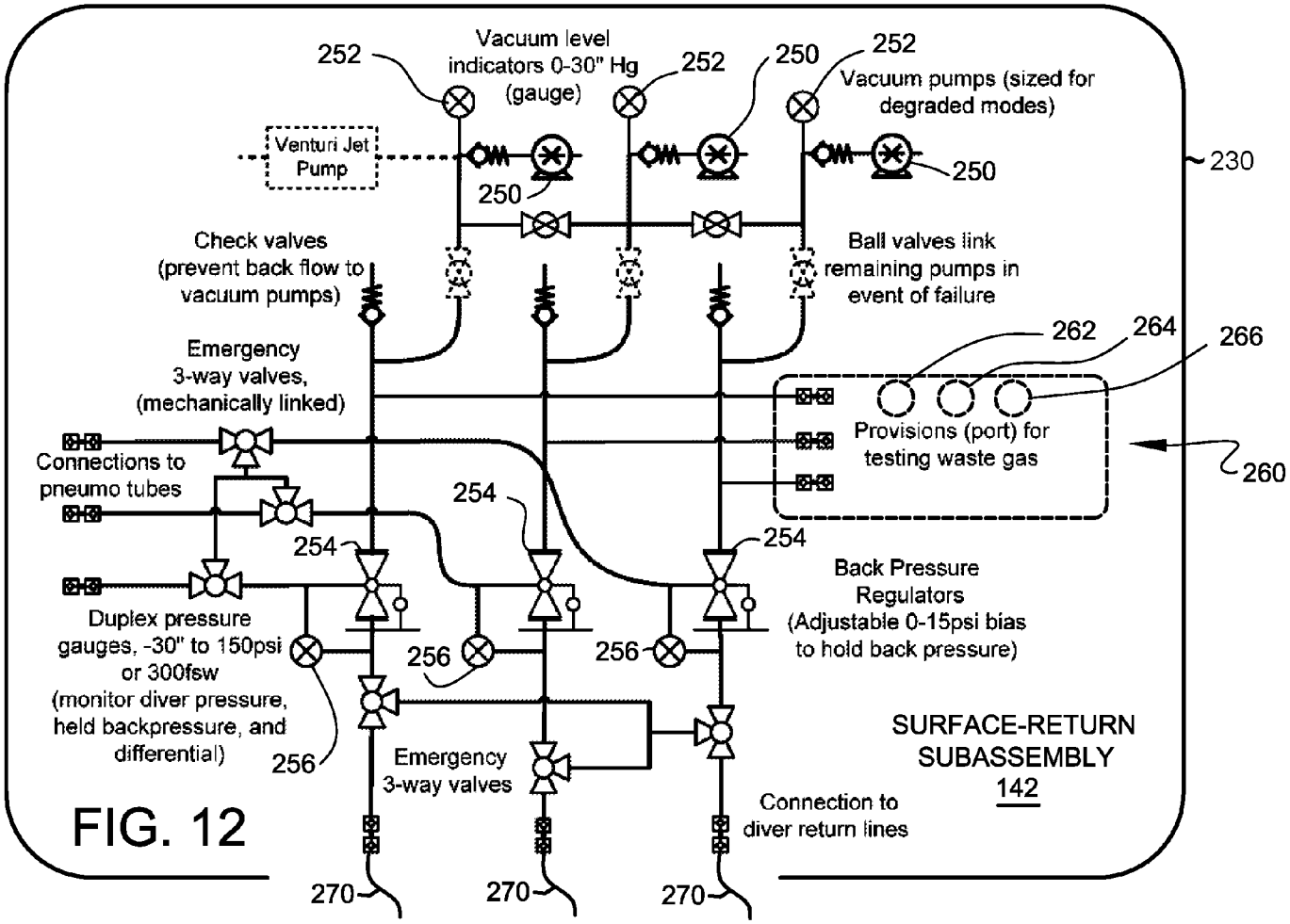
FIG. 12 shows a schematic diagram, illustrating preferred arrangements of a surface-return subassembly, according to the preferred embodiment of FIG. 1.

FIG. 12 shows a schematic diagram, illustrating preferred arrangements of surface-return subassembly 142, according to the preferred embodiment of FIG. 1. Surface-return subassembly 142 preferably comprises surface-return hose 170 and surface control unit 230, as shown in both FIG. 1 and FIG. 12. Preferably, surface-return hose 170 conducts exhaust gases from helmet-mounted subassembly 140 to surface control unit 230, as shown. Testing by applicant indicated that a 0.75 inch inside diameter return hose performs well with capacity for additional flow.

Preferably, surface control unit 230 is configured to provide an indication of diver pressure and backpressure regulator pressure, provisions for testing return gas for hazardous materials 109, at least one vacuum source for shallow mode operations, and at least one backpressure regulator to hold backpressure on DER 154.

Preferably, surface control unit 230 comprises at least one reduced-pressure source, more preferably, at least one vacuum pump 250, most preferably, at least two vacuum pumps 250 for redundancy. Preferably, each vacuum pump 250 is used to maintain vacuum on DER 154 at all times during dive operations. Crossovers between pumps are preferably provided, as shown, to allow for single fault tolerance in the event of a single pump failure. Preferably, each vacuum pump 250 comprises at least one vacuum monitoring gauge 252 adapted to monitor generated vacuum levels. Preferably, vacuum pump 250 is capable of handling at least 62.5 liters per minute with 7.5 pounds per square inch vacuum. Vacuum pump 250 is preferably of oil-less rotary vane design.

Preferably, the reduced pressure produced by vacuum pumps 250 is communicated to surface-return hose 170 through a system of pressure controls and pressure monitors, as shown (at least embodying herein at least one reduced-pressure communicator structured and arranged to establish fluid communication between such at least one reduced-pressure source and such at least one breathing-gas return hose). Preferably, backpressure regulator 254 is structured and arranged to regulate levels of reduced atmospheric pressure communicated between vacuum pumps 250 and surface-return hose 170, as shown.

Preferably, surface control unit 230 further comprises at least one pressure indicator, more preferably at least one duplex pressure gauge 256 structured and arranged to indicate at least one pneumatic reference pressure, and at least one indication of the operating pressure at DER 154. More specifically, duplex pressure gauge 256 preferably displays pneumofathometer reference pressure and pressure at backpressure regulator 254, as shown. Preferably, the difference between the two measurements indicates the bias held by backpressure regulator 254. Preferably, duplex pressure gauge 256 is capable of displaying −30 inHg to 150 psi. A preferred gauge suitable for use as duplex pressure gauge 256 includes the Weksler model BB14P by Weksler Glass Thermometer Corp. of Charlottesville, Va.

Preferably, surface control unit 230 further comprises at least one breathing-gas monitoring unit 260 structured and arranged to monitor the exhausted breathing gas of the breathing environment for levels of hazardous material 109. Preferably, breathing-gas monitor comprises at least one breathing-gas sampling component 262 structured and arranged to sample the breathing gas of the at least one breathing environment, as shown. Preferably, gas samples are taken at sampling ports located between backpressure regulator 254 and vacuum pumps 250, as shown. Preferably, breathing-gas monitoring unit 260 further comprises at least one measurement component 264 structured and arranged to measure the levels of the at least one hazardous material of the sampled breathing gas to determine if the levels of the at least one hazardous material fall within a preset range. In addition, breathing-gas monitoring unit 260 preferably comprises at least one hazardous-condition indicator 266 designed to indicate if the levels of hazardous material 109 within the breathing environment has exceeded the preset range. If such a condition were to occur, hazardous-condition indicator 266 would preferably provide an indication to the surface tender/operator to allow risk-mitigating steps to be taken. Upon reading the teachings of this specification, those of ordinary skill in the art will now understand that, under appropriate circumstances, considering such issues as intended use, hazardous environment, etc., other monitoring arrangements, such as in-helmet chemical detectors, water sampling devices, etc., may suffice.

Figure 13:
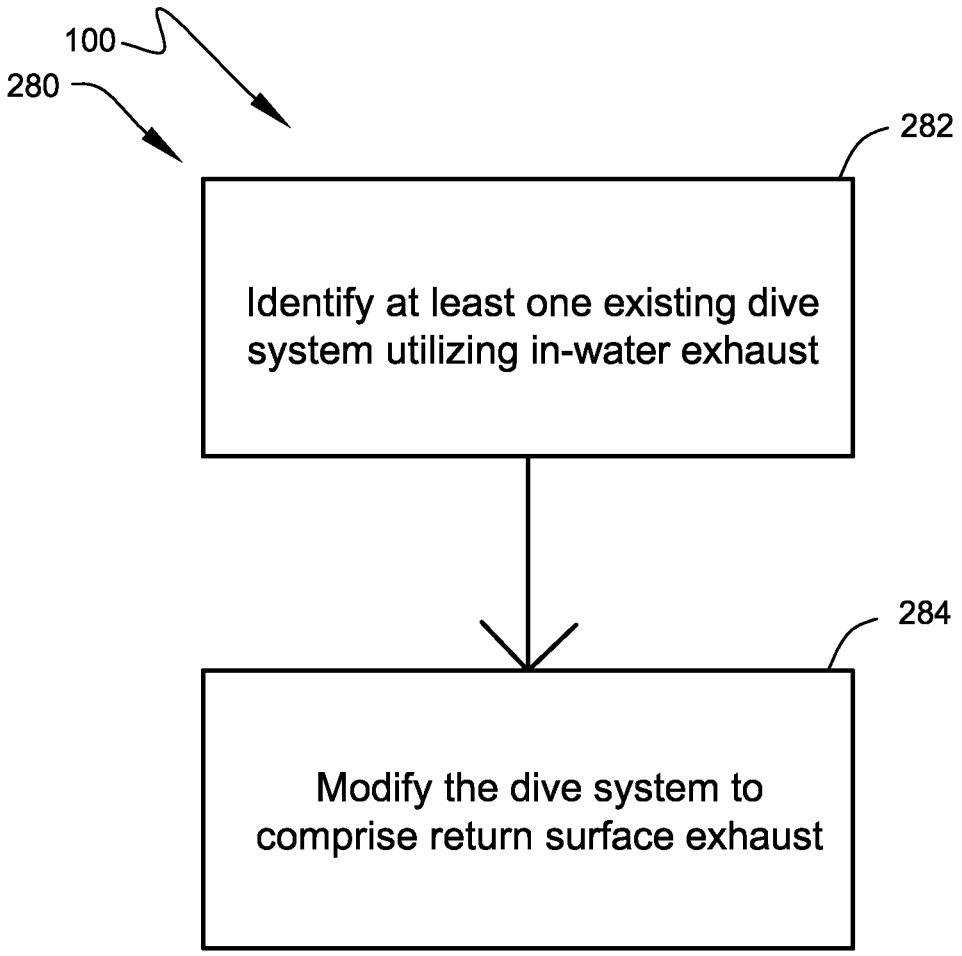
FIG. 13 shows a flow diagram illustrating a preferred method of using a retrofitted underwater dive system to avoid health hazards relating to special diving operations, according to a preferred method of the present invention.

FIG. 13 shows a schematic diagram illustrating a preferred method of using a retrofitted underwater dive system (HMRSEDS 300) to avoid health hazards relating to special diving operations, according to a preferred method of the present invention. In accordance with the above-described preferred embodiments of hazardous-environmental diving system 100, there is provided method 280, related to use of a retrofitted existing underwater dive system 101 to avoid health hazards relating to at least one diver operating in waters needed to be essentially uncontaminated, such method comprising the following steps. In initial step 282, an existing underwater dive system 101 is identified to be used in specialized diving operations. Such specialized diving operation may preferably include the carrying out of maintenance work within a municipal reservoir where biological contaminants conveyed within the diver's exhausted breath may create a health hazard within the body of water in which the diver operates.

Preferably, existing underwater dive system 101 is modified by removing the in-water exhaust subsystem 114, and adding RSE assembly 104 (at least embodying herein at least one surface-return exhaust subsystem) to enable the return of breathing gas from the breathing environment of dive helmet 103 to the surface, as indicated in preferred step 284. Thus, use of such at least one retrofitted existing commercial dive system in such waters assists in avoiding water contamination relating to such exhaust breathing gas.

Figure 14:
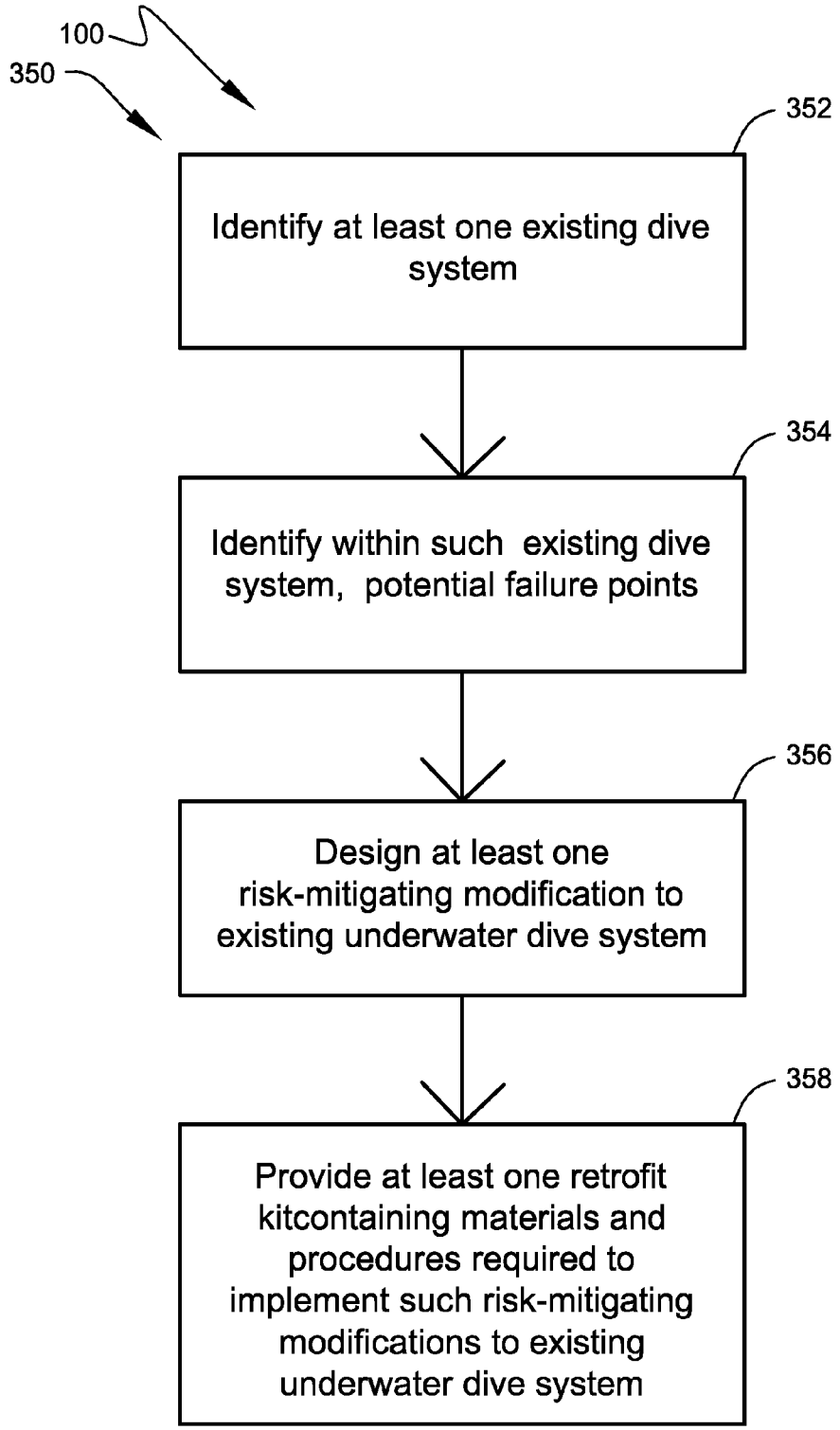
FIG. 14 shows a flow diagram illustrating a preferred method of retrofitting an existing underwater dive system to avoid health hazards relating to special diving operations, according to a preferred method of the present invention.

FIG. 14 shows a flow diagram illustrating preferred method 350 related to retrofitting existing underwater dive system 101, in accordance with the above-described preferred embodiments of hazardous-environmental diving system 100, according to a preferred method of the present invention. In the initial preferred step 352 of method 350, at least one existing underwater dive system 101 is identified. Next, as indicated in preferred step 354, potential hazardous-material-caused failure points, which may result in injurious introduction of at least one hazardous material 109 into the diver's breathing environment during the operational duration, are preferably identified within existing underwater dive system 101. This may preferably include analysis and identification of materials vulnerable to direct chemical degradation and chemical infiltration. In preferred step 356, at least one risk-mitigating modification to existing underwater dive system 101 is designed, such at least one risk-mitigating modification structured and arranged substantially mitigate risks associated with the hazardous-material-caused failure points identified in step 354. Next, as indicated in preferred step 358 at least one retrofit kit is provided, preferably containing materials and procedures required to implement such risk-mitigating modifications to existing underwater dive system 101 to produce HMRSEDS 300, preferably comprising HEMA 102. In preferred step 358, at least one of the risk-mitigating modifications comprises the replacement of at least one existing chemically-sensitive component with at least one flouroelastomer replacement.

Figure 15:
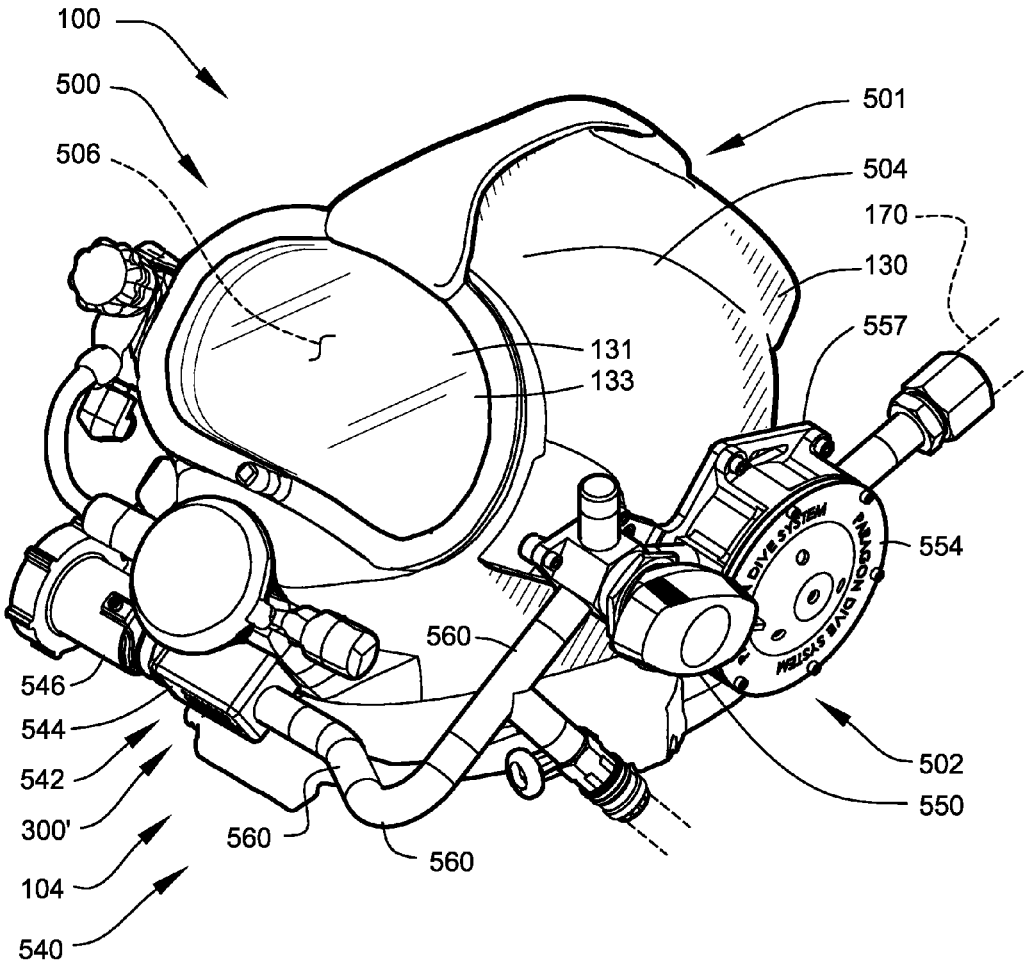
FIG. 15 shows a perspective view illustrating a "factory hardened" dive helmet, preconfigured to enhance diver safety during operation in waters containing at least one hazardous material, according to another preferred embodiment of the present invention.

The following section describes applicant's preferred "factory hardened" embodiments forming alternate HMRSEDS 300' of applicant's hazardous-environmental diving system 100. In that regard, FIG. 15 shows a perspective view illustrating a "factory hardened" dive helmet 500 that has been factory pre-configured to provide increased diver safety during operation in waters containing at least one hazardous material. It is noted that dive helmet 500 comprises physical arrangements substantially similar to the post-retrofit embodiments of the prior figures; thus, only the differences between dive helmet 500 and the prior embodiment will be elaborated upon.

Dive helmet 500 is preferably supplied in essentially a ready-to-use "pre-hardened" configuration. In a minimum preferred configuration, dive helmet 500 preferably incorporates and implements the hazard-mitigating features afforded to the above-described diving equipment embodiments, after installation of HEMA 102.

To further increase the safety of underwater divers utilizing this preferred variant of applicant's system, dive helmet 500 preferably comprises a set of additional protective enhancements to further improve diver protection from waterborne contaminants, such as toxic compounds (marine diesel, jet fuel), biological compounds (bacteria, biological warfare agents) and chemical warfare agents.

Applicant's preferred dive apparatus is designed to generate and maintain a fully-protected breathing environment during dive operations. Preferred embodiments of hazardous-environmental diving system 100, preferably including HMRSEDS 300', incorporate contaminate-resistant materials and physical configurations to limit or prevent the intrusion of hazardous materials, thus forming essentially a continuous protective barrier around the diver's breathing environment.

Alternate HMRSEDS 300' preferably comprises an arrangement of components 502 structured and arranged to, when operably associated, assist in forming a protected breathing environment during dive operation. In one preferred embodiment of the present system, components 502 at least comprise a pre-configured dive helmet 500 and a surface-return subassembly 542 functionally equivalent to the previously described surface-return subassembly 142 (at least embodying herein at least one surface-supplied breathing-gas subsystem). Upon reading the teachings of this specification, those of ordinary skill in the art will now understand that, under appropriate circumstances, considering such issues as intended use, hazardous environment, etc., other protective equipment arrangements, such as utilization of chemically hardened dry-suit materials, implementation of suit dump valves that exhaust to the surface through the return umbilical, etc., may suffice.

Dive helmet 500 preferably comprises at least one continuous barrier 501 structured and arranged to limit transmission of hazardous materials between the contaminated water and the diver's protected breathing environment. A portion of barrier 501 is preferably formed by an outer shell 504 that defines at least one internal cavity 506 into which the diver's head and cervical anatomy can be situated.

Preferably, outer shell 504 of dive helmet 500 is constructed from one or more materials that exhibit low transmissibility with respect to waterborne hazardous materials and is preferably configured to limit intrusion of hazardous quantities of the hazardous materials into the breathing environment, thus reducing transmission of the hazardous materials through outer shell 504.

In one preferred embodiment of the present system, outer shell 504 is constructed of stainless steel. Alternately preferably, outer shell 504 is constructed of one or more chemical-resistant polymers, which may further a chemical-resistant coating 130. In addition, soft-goods (i.e., O-rings, diaphragms, seals, gaskets, etc.) of dive helmet 500 preferably comprise one or more elastomers based on fluorine chemistry, preferably fluorocarbon elastomers based on fluorinated organic polymers having carbon-to-carbon linkages as the foundation of their molecular structures (at least embodying herein wherein at least one portion of such at least one continuous barrier comprises at least one flouroelastomer composition). Additionally, all exposed sealants used in dive helmet 500 are of flouroelastomer-based compositions that function to reduce migration of hazardous quantities of the hazardous materials, into the breathing environment of dive helmet 500, by interstitial penetration of the at least one hazardous materials between components.

Dive helmet 500 is preferably fitted with components corresponding to the prior-described regulated Surface Exhaust (RSE) assembly 104, surface-supplied breathing-gas subsystem 112, surface-return subassembly 142, etc. In the present embodiment, RSE assembly 104 preferably comprises helmet-mounted subassembly 540 and surface-return subassembly 142, as shown in FIG. 1. The modified locations of the components of helmet-mounted subassembly 540 reflect optimization of the factory-supplied helmet, as shown.

Preferred component arrangements of helmet-mounted subassembly 540 closely correspond to the helmet-mounted subassembly 140 of the prior-described embodiment. Thus, preferred components of helmet-mounted subassembly 540 preferably include exhaust plenum 544, emergency dump valve 546, three-way bypass valve 550, Demand Exhaust Regulator (DER) 554, etc. In addition, helmet-mounted subassembly 540 preferably comprises a modified support plate 557 to support DER 554 in a more lateral position relative to outer shell 504. A plurality of connector fittings 560 are preferably employed to operably couple the various components within the gas supply and exhaust flow path, as shown.

In factory-hardened embodiments, the breathing-gas supply hose of supply umbilical 105 (see FIG. 1) preferably comprises at least one chemical-resistant hose material structured and arranged to maintain the functional integrity of the at least one breathing-gas supply hose when such breathing-gas supply hose is in contact with the hazardous material. In some preferred embodiments of the present system, breathing-gas return hose 170 (see also FIG. 1) also preferably comprises at least one chemical-resistant hose material. Preferred integrated hose materials include FKM, Viton®, and Teflon®. Alternately preferably, the supply and return hoses are hardened by wrapping, as previously described.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system relating to protective underwater dive systems, said system comprising:

i) at least one dive helmet;

ii) at least one surface-supplied breathing-gas subsystem coupled to a breathing environment of the at least one dive helmet; and iii) at least one surface-return exhaust subsystem configured to exhaust breathing gas from the breathing environment to a breathable atmosphere outside of the at least one dive helmet, wherein the at least one surface-return exhaust subsystem comprises:

at least one return hose configured to return the breathing gas to the breathable atmosphere;

at least one demand exhaust regulator configured to serve as a pressure-actuated valve and configured to control, on demand, exhausting of the breathing gas from the breathing environment to the at least one return hose, wherein the at least one demand exhaust regulator comprises:

a valve housing having an inlet duct and an outlet duct;

a valve seat inside the valve housing and between the inlet duct and the outlet duct, wherein the valve seat comprises a plurality of gas-conducting passages to enable flow of the breathing gas from the inlet duct to the outlet duct, wherein the valve seat further comprises at least one central bore configured to be in fluid communication with the inlet duct, and at least one circumferential sealing surface extending radially outward of the at least one central bore; and an exhaust diaphragm inside the valve housing and superimposed over the valve seat, wherein the at least one circumferential sealing surface is configured to form a pressure seal with the exhaust diaphragm, wherein an upper portion of the at least one central bore comprises a smooth transition surface between the at least one circumferential sealing surface and a lower portion of the at least one central bore, wherein the exhaust diaphragm is movable between a flow-blocking position to block passage of the breathing gas from the inlet duct through the plurality of gas-conducting passages and a flow-delivery position to expose at least some of the plurality of gas-conducting passages to enable passage of the breathing gas from the inlet duct through the at least some of the plurality of gas-conducting passages to the outlet duct, each of the plurality of gas-conducting passages comprising a frustoconical aperture and located within the at least one circumferential sealing surface.

2. The system according to claim 1 further comprising one or more soft-goods components, the one or more soft-goods components including one or more of: o-rings, diaphragms, seals, and gaskets, wherein the one or more soft-goods components includes a fluoroelastomer composition.

3. The system according to claim 2 wherein said at least one surface-return exhaust subsystem comprises:

at least one exhaust coupler coupled with the at least one demand exhaust regulator and the breathing environment of said at least one dive helmet;

wherein at least one demand-based exhaust pathway is established between the breathing environment of said at least one dive helmet and the breathable atmosphere outside of the at least one dive helmet.

4. The system according to claim 3 wherein said at least one surface-return exhaust subsystem further comprises:

adjacent to said at least one exhaust coupler, at least one over-pressure relief valve structured and arranged to relieve over pressures within the breathing environment within said at least one dive helmet; and between said at least one exhaust coupler and said at least one demand exhaust regulator, at least one gas-flow control valve configured to control routing of the breathing gas between the breathing environment of said at least one dive helmet, said at least one demand exhaust regulator, and said at least one return hose;

wherein said at least one gas-flow control valve comprises:

at least one first flow setting to enable exhausting of the breathing gas from the breathing environment of said at least one dive helmet to said at least one demand exhaust regulator, at least one second flow setting to enable exhausting of the breathing gas from the breathing environment of said at least one dive helmet directly to said at least one return hose without passage through said at least one demand exhaust regulator, and at least one third flow setting to enable exhausting of the breathing gas from the breathing environment of said at least one dive helmet through said at least one over-pressure relief valve by preventing exhausting of the breathing gas through said at least one demand exhaust regulator and said at least one return hose.

5. The system according to claim 3 wherein said at least one surface-return exhaust subsystem further comprises:

at least one reduced-pressure source configured to provide at least one source of reduced atmospheric pressure;

at least one reduced-pressure communicator configured to establish fluid communication between said at least one reduced-pressure source and said at least one return hose; and at least one back-pressure regulator configured to regulate levels of reduced atmospheric pressure communicated between said at least one reduced-pressure source and said at least one return hose.

6. The system according to claim 3 wherein said at least one surface-return exhaust subsystem further comprises:

at least one pressure indicator configured to indicate at least one pneumatic reference pressure, and at least one indication of operating pressure at said at least one demand exhaust regulator; and at least one breathing-gas monitor configured to monitor the breathing gas of the breathing environment for levels of one or more hazardous materials.

7. The system according to claim 3 wherein the at least one surface-supplied breathing-gas subsystem comprises at least one breathing-gas supply hose coupled to the breathing environment of the at least one dive helmet.

8. The system according to claim 7 wherein the at least one breathing-gas supply hose comprises at least one fluoroelastomer sheath.

9. The system according to claim 1 wherein said at least one dive helmet further comprises:

at least one outer-shell-portion defining at least one internal cavity;

wherein said at least one outer-shell-portion is configured to limit intrusion of hazardous quantities of at least one hazardous material into the breathing environment.

10. The system according to claim 9 further comprising:

at least one helmet coating configured to coat the at least one outer-shell-portion of said at least one dive helmet;

wherein said at least one helmet coating is further configured to reduce transmission of hazardous quantities of the at least one hazardous material into the breathing environment.

11. The system according to claim 1 wherein:

each frustoconical aperture comprises at least one inlet diameter, and at least one outlet diameter larger than the at least one inlet diameter and configured to optimize mass flow through the valve seat when the exhaust diaphragm is in the flow-delivery position.

12. The system according to claim 11 wherein said exhaust diaphragm is further configured to conform to said at least one circumferential sealing surface in the flow-blocking position.

13. The system according to claim 12 wherein said exhaust diaphragm further comprises:

at least one asymmetrical stiffener configured to structurally stiffen at least one portion of said exhaust diaphragm.

14. A method, relating to the generation of protective underwater dive systems, said method comprising the steps of:

providing at least one dive helmet;

modifying the at least one dive helmet to couple at least one surface-supplied breathing-gas subsystem to a breathing environment of the at least one dive helmet; and modifying the at least one dive helmet to couple at least one surface-return exhaust subsystem from the breathing environment of the at least one dive helmet to a breathable atmosphere outside of the at least one dive helmet, the at least one surface-return exhaust subsystem configured to exhaust breathing gas from the breathing environment to the breathable atmosphere, wherein the at least one surface-return exhaust subsystem comprises:

at least one return hose configured to return the breathing gas to the breathable atmosphere;

at least one demand exhaust regulator configured to serve as a pressure-actuated valve and configured to control, on demand, exhausting of the breathing gas from the breathing environment to the at least one return hose, wherein the at least one demand exhaust regulator comprises:

a valve housing having an inlet duct and an outlet duct;

a valve seat inside the valve housing and between the inlet duct and the outlet duct, wherein the valve seat comprises a plurality of gas-conducting passages to enable flow of the breathing gas from the inlet duct to the outlet duct, wherein the valve seat further comprises at least one central bore configured to be in fluid communication with the inlet duct, and at least one circumferential sealing surface extending radially outward of the at least one central bore; and an exhaust diaphragm inside the valve housing and superimposed over the valve seat, wherein the at least one circumferential sealing surface is configured to form a pressure seal with the exhaust diaphragm, wherein an upper portion of the at least one central bore comprises a smooth transition surface between the at least one circumferential sealing surface and a lower portion of the at least one central bore, wherein the exhaust diaphragm is movable between a flow-blocking position to block passage of the breathing gas from the inlet duct through the plurality of gas-conducting passages and a flow-delivery position to expose at least some of the plurality of gas-conducting passages to enable passage of the breathing gas from the inlet duct through the at least some of the plurality of gas-conducting passages to the outlet duct, each of the plurality of gas-conducting passages comprising a frustoconical aperture and located within the at least one circumferential sealing surface.

15. The method according to claim 14, further comprising:

providing one or more soft-goods components, the one or more soft-goods components including one or more of: o-rings, diaphragms, seals, and gaskets, wherein the one or more soft-goods components include a fluoroelastomer.

16. A system relating to protective underwater dive systems, said system comprising:

i) at least one dive helmet;

ii) at least one surface-supplied breathing-gas subsystem coupled to a breathing environment of the at least one dive helmet; and iii) at least one surface-return exhaust subsystem configured to exhaust breathing gas from the breathing environment to a breathable atmosphere outside of the at least one dive helmet, wherein the at least one surface-return exhaust subsystem comprises:

at least one return hose configured to return the breathing gas to the breathable atmosphere; and at least one demand exhaust regulator configured to serve as a pressure-actuated valve and configured to control, on demand, exhausting of the breathing gas from the breathing environment to the at least one return hose; and at least one over-pressure relief valve configured to relieve pressure within the breathing environment;

wherein the at least one surface-return exhaust subsystem is capable of exhausting the breathing gas from the breathing environment to the at least one demand exhaust regulator, exhausting the breathing gas from the breathing environment to the at least one return hose without passage through the at least one demand exhaust regulator, and exhausting the breathing gas from the breathing environment through the at least one over-pressure relief valve without passage through the at least one demand exhaust regulator and the at least one return hose.

17. The system according to claim 16 further comprising one or more soft-goods components, the one or more soft-goods components including one or more of: o-rings, diaphragms, seals, and gaskets, wherein the one or more soft-goods components include a fluoroelastomer.

* * * * *